US006283568B1

(12) United States Patent
Horii et al.

(10) Patent No.: US 6,283,568 B1
(45) Date of Patent: Sep. 4, 2001

(54) INK-JET PRINTER AND APPARATUS AND METHOD OF RECORDING HEAD FOR INK-JET PRINTER

(75) Inventors: Shinichi Horii; Tooru Tanikawa; Yuichiro Ikemoto; Masaki Kishimoto; Yasuo Yukita, all of Kanagawa; Hiroshi Tokunaga, Tokyo, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/138,977

(22) Filed: Aug. 24, 1998

(51) Int. Cl.[7] ..... B41J 29/35; B41J 2/205; B41J 29/393; B41J 2/165; B41J 2/21

(52) U.S. Cl. ..... 347/10; 347/11; 347/15; 347/14; 347/19; 347/23; 347/43

(58) Field of Search ..... 347/10, 15, 43, 347/11, 14, 23, 19, 12, 9, 13, 40

(56) References Cited

U.S. PATENT DOCUMENTS 4,471,363 * 9/1984 Hanaoka ..... 347/10
4,897,667 * 1/1990 Uchiyama et al. ..... 347/10
5,130,720 * 7/1992 Lopez et al. ..... 347/10

FOREIGN PATENT DOCUMENTS 406 031 932 * 2/1994 (JP) ..... 347/10

* cited by examiner

*Primary Examiner*—John Barlow
*Assistant Examiner*—Charles W. Stewart, Jr.
(74) *Attorney, Agent, or Firm*—Jay H. Maioli

(57) ABSTRACT

An ink-jet printer and an apparatus and a method of driving a recording head for an ink-jet printer are provided for faithfully performing various image representations through ink droplet ejection driving signals of different waveforms. Based on a waveform selection signal from a selection controller, a waveform selector selects one of a plurality of drive signals from a drive waveform generator in a time-division manner. The selected signal is supplied to a piezo-electric element of a corresponding nozzle. Control is thereby performed on ink droplet ejection with a drive signal having a temporally varying waveform. The drive signals include a signal having a varying voltage waveform that disables ink droplet ejection in isolation from another waveform. A new composite drive signal waveform is generated by time-divisional selection not only at a point between ejection cycles but also at a point during the ejection cycle.

18 Claims, 23 Drawing Sheets waveform of 1 cycle(T)
τM
τ5
τ4
τ3
τ2
τ1 drive signal
145-1
V2(1)
V1
0V
t1(1)

drive signal
145-2
V2(2)
V1
0V
t1(2)

drive signal
145-3
V2(3)
V1
0V
t1(3)

drive signal
145-N
V2(N)
V1
0V
t1(N)
ts
ts
ts'

τ5
τ4
τ3
τ2
τ1
V2(1)
drive signal
145-1
V1
0V
t1(1)

V2(2)
drive signal
145-2
V1
0V
t1(2)

ts
ts
ts'

| waveform name | composite waveform | waveform composition | | | | |
|---|---|---|---|---|---|---|
| | | τ5 | τ4 | τ3 | τ2 | τ1 |
| α 1 | t1(2) V2(1) V1 0V | 2 | 2 | 1 | 1 | 1 |
| α 2 | t1(1) V2(1) V1 0V | 1 | 1 | 1 | 1 | 1 |
| β 1 | t1(2) V2(2) V1 0V | 2 | 2 | 1 | 1 | 2 |
| β 2 | t1(1) V2(2) V1 0V | 1 | 1 | 1 | 1 | 2 |
| no ejection | V2(2) V1 0V | 2 | 2 | 2 | 2 | 2 |

FIG.10

τ5
τ4
τ3
τ2
τ1
V2(1)
drive signal
145-1
V1
0V
t1(1)

V2(2)
drive signal
145-2
V1
0V
t1(2)

V2(3)
drive signal
145-3
V1
0V
t1(3)

ts
ts
ts'

| waveform name | composite waveform | waveform composition | | | | |
|---|---|---|---|---|---|---|
| | | τ5 | τ4 | τ3 | τ2 | τ1 |
| α1 | V2(1)-V1, V2(1), V1, 0V | 1 | 1 | 2 | 2 | 1 |
| α2 | t1(3), V2(1), V1, 0V | 3 | 2 | 1 | 1 | 1 |
| α3 | t1(2), V2(1), V1, 0V | 2 | 2 | 1 | 1 | 1 |
| α4 | t1(1), V2(1), V1, 0V | 1 | 1 | 1 | 1 | 1 |
| β1 | V2(2)-V1, V2(2), V1, 0V | 1 | 1 | 2 | 2 | 2 |
| β2 | t1(3), V2(2), V1, 0V | 3 | 2 | 1 | 1 | 2 |
| β3 | t1(2), V2(2), V1, 0V | 2 | 2 | 1 | 1 | 2 |
| β4 | t1(1), V2(2), V1, 0V | 1 | 1 | 1 | 1 | 2 |
| γ1 | V2(3)-V1, V2(3), V1, 0V | 1 | 1 | 2 | 2 | 3 |
| γ2 | t1(3), V2(3), V1, 0V | 3 | 2 | 1 | 1 | 3 |
| γ3 | t1(2), V2(3), V1, 0V | 2 | 2 | 1 | 1 | 3 |
| γ4 | t1(1), V2(3), V1, 0V | 1 | 1 | 1 | 1 | 3 |
| no ejection | V2(3), V1, 0V | 3 | 3 | 3 | 3 | 3 |

FIG.12 drive signal
145-1 drive signal
145-2 drive signal
145-3 drive signal
21-1
ts
ts
ts
ts'
ts'
α2
γ3

| waveform name | waveform composition | | | | | | | | | | |
|---|---|---|---|---|---|---|---|---|---|---|---|
| | τM | τ(M-1) | τ(M-2) | ------ | τ7 | τ6 | τ5 | τ4 | τ3 | τ2 | τ1 |
| α1 | 1 | 1 | 1 | ------ | 1 | 1 | 1 | 1 | 2 | 2 | 1 |
| α2 | N | N | N | ------ | 5 | 4 | 3 | 2 | 1 | 1 | 1 |
| α3 | N-1 | N-1 | N-1 | ------ | 5 | 4 | 3 | 2 | 1 | 1 | 1 |
| α4 | N-2 | N-2 | N-2 | ------ | 5 | 4 | 3 | 2 | 1 | 1 | 1 |
| ⋮ | ⋮ | ⋮ | ⋮ | ⋱ | ⋮ | ⋮ | ⋮ | ⋮ | ⋮ | ⋮ | ⋮ |
| α(N-2) | 4 | 4 | 4 | ------ | 4 | 4 | 3 | 2 | 1 | 1 | 1 |
| α(N-1) | 3 | 3 | 3 | ------ | 3 | 3 | 3 | 2 | 1 | 1 | 1 |
| αN | 2 | 2 | 2 | ------ | 2 | 2 | 2 | 2 | 1 | 1 | 1 |
| α(N+1) | 1 | 1 | 1 | ------ | 1 | 1 | 1 | 1 | 1 | 1 | 1 |
| β1 | 1 | 1 | 1 | ------ | 1 | 1 | 1 | 1 | 2 | 2 | 2 |
| β2 | N | N | N | ------ | 5 | 4 | 3 | 2 | 1 | 1 | 2 |
| β3 | N-1 | N-1 | N-1 | ------ | 5 | 4 | 3 | 2 | 1 | 1 | 2 |
| β4 | N-2 | N-2 | N-2 | ------ | 5 | 4 | 3 | 2 | 1 | 1 | 2 |
| ⋮ | ⋮ | ⋮ | ⋮ | ⋱ | ⋮ | ⋮ | ⋮ | ⋮ | ⋮ | ⋮ | ⋮ |
| β(N-2) | 4 | 4 | 4 | ------ | 4 | 4 | 3 | 2 | 1 | 1 | 2 |
| β(N-1) | 3 | 3 | 3 | ------ | 3 | 3 | 3 | 2 | 1 | 1 | 2 |
| βN | 2 | 2 | 2 | ------ | 2 | 2 | 2 | 2 | 1 | 1 | 2 |
| β(N+1) | 1 | 1 | 1 | ------ | 1 | 1 | 1 | 1 | 1 | 1 | 2 |
| ⋮ | ⋮ | ⋮ | ⋮ | ⋮ | ⋮ | ⋮ | ⋮ | ⋮ | ⋮ | ⋮ | ⋮ |
| ζ1 | 1 | 1 | 1 | ------ | 1 | 1 | 1 | 1 | 2 | 2 | N |
| ζ2 | N | N | N | ------ | 5 | 4 | 3 | 2 | 1 | 1 | N |
| ζ3 | N-1 | N-1 | N-1 | ------ | 5 | 4 | 3 | 2 | 1 | 1 | N |
| ζ4 | N-2 | N-2 | N-2 | ------ | 5 | 4 | 3 | 2 | 1 | 1 | N |
| ⋮ | ⋮ | ⋮ | ⋮ | ⋱ | ⋮ | ⋮ | ⋮ | ⋮ | ⋮ | ⋮ | ⋮ |
| ζ(N-2) | 4 | 4 | 4 | ------ | 4 | 4 | 3 | 2 | 1 | 1 | N |
| ζ(N-1) | 3 | 3 | 3 | ------ | 3 | 3 | 3 | 2 | 1 | 1 | N |
| ζN | 2 | 2 | 2 | ------ | 2 | 2 | 2 | 2 | 1 | 1 | N |
| ζ(N+1) | 1 | 1 | 1 | ------ | 1 | 1 | 1 | 1 | 1 | 1 | N |
| no ejection | N | N | N | ------ | N | N | N | N | N | N | N |

FIG.14

τ 2
τ 1 drive signal
545-1
V1
0V
V2(1)

drive signal
545-2
V1
0V
t1(1)
V2(2)

drive signal
545-3
V1
0V
t1(2)
ts
ts'
ts

| waveform name | composite waveform | waveform composition | |
|---|---|---|---|
| | | τ2 | τ1 |
| α1 | V2(1) V1 0V | 1 | 2 |
| α2 | t1(2) V2(1) V1 0V | 3 | 2 |
| α3 | t1(1) V2(1) V1 0V | 2 | 2 |
| β1 | V2(2) V1 0V | 1 | 3 |
| β2 | t1(2) V2(2) V1 0V | 3 | 3 |
| β3 | t1(1) V2(2) V1 0V | 2 | 3 |
| no ejection | V1 0V | 1 | 1 |

FIG.16 waveform of 1 cycle(T)
τM
τ5
τ4
τ3
τ2
τ1 drive signal
245-1
V1
V2(1)
0V
t1(1)

drive signal
245-2
V1
V2(2)
0V
t1(2)

drive signal
245-3
V1
V2(3)
0V
t1(3)

drive signal
245-N
V1
V2(N)
0V
t1(N)
ts
ts
ts'

τ 5
τ 4
τ 3
τ 2
τ 1
V2(1)
V1 drive signal
245-1
0V
t1(1)
V2(2)
V1 drive signal
245-2
0V
t1(2)
ts
ts
ts'

| waveform name | composite waveform | waveform composition | | | | |
|---|---|---|---|---|---|---|
| | | τ5 | τ4 | τ3 | τ2 | τ1 |
| α1 | V2(1) 0V | 1 | 2 | 1 | 1 | 1 |
| α2 | V1 t1(2) V2(1) 0V | 2 | 2 | 1 | 1 | 1 |
| α3 | V1 t1(1) V2(1) 0V | 1 | 1 | 1 | 1 | 1 |
| β1 | V2(2) 0V | 1 | 2 | 1 | 1 | 2 |
| β2 | V1 t1(2) V2(2) 0V | 2 | 2 | 1 | 1 | 2 |
| β3 | V1 t1(1) V2(2) 0V | 1 | 1 | 1 | 1 | 2 |
| no ejection | V1 V2(2) 0V | 2 | 2 | 2 | 2 | 2 |

FIG.20

FIG.21A drive signal 245-1

FIG.21B drive signal 245-2

FIG.21C drive signal 245-3

| waveform name | composite waveform | waveform composition | | | | |
|---|---|---|---|---|---|---|
| | | τ5 | τ4 | τ3 | τ2 | τ1 |
| α1 | V2(1) 0V | 1 | 1 | 2 | 1 | 1 |
| α2 | V1 t1(3) V2(1) 0V | 3 | 1 | 2 | 1 | 1 |
| α3 | V1 t1(2) V2(1) 0V | 2 | 2 | 2 | 1 | 1 |
| α4 | V1 t1(1) V2(1) 0V | 1 | 1 | 1 | 1 | 1 |
| β1 | V2(2) 0V | 1 | 1 | 2 | 2 | 2 |
| β2 | V1 t1(3) V2(2) 0V | 3 | 1 | 2 | 2 | 2 |
| β3 | V1 t1(2) V2(2) 0V | 2 | 2 | 2 | 2 | 2 |
| β4 | V1 t1(1) V2(2) 0V | 1 | 1 | 1 | 2 | 2 |
| γ1 | V2(3) 0V | 1 | 1 | 2 | 1 | 3 |
| γ2 | V1 t1(3) V2(3) 0V | 3 | 1 | 2 | 1 | 3 |
| γ3 | V1 t1(2) V2(3) 0V | 2 | 2 | 2 | 1 | 3 |
| γ4 | V1 t1(1) V2(3) 0V | 1 | 1 | 1 | 1 | 3 |
| no ejection | 0V | 3 | 3 | 3 | 3 | 3 |

FIG.22

| waveform name | waveform composition | | | | | | | | | |
|---|---|---|---|---|---|---|---|---|---|---|
| | τM | τ(M-1) | τ(M-2) | ------ | τ6 | τ5 | τ4 | τ3 | τ2 | τ1 |
| α1 | 1 | 1 | 1 | ------ | 1 | 1 | 1 | 2 | 1 | 1 |
| α2 | N | 1 | 1 | ------ | 1 | 1 | 1 | 2 | 1 | 1 |
| α3 | 1 | N-1 | 1 | ------ | 1 | 1 | 1 | 2 | 1 | 1 |
| α4 | 1 | 1 | N-2 | ------ | 1 | 1 | 1 | 2 | 1 | 1 |
| ⋮ | ⋮ | ⋮ | ⋮ | ⋱ | ⋮ | ⋮ | ⋮ | ⋮ | ⋮ | ⋮ |
| α(N-2) | 1 | 1 | 1 | ------ | 4 | 1 | 1 | 2 | 1 | 1 |
| α(N-1) | 1 | 1 | 1 | ------ | 1 | 3 | 1 | 2 | 1 | 1 |
| αN | 1 | 1 | 1 | ------ | 1 | 1 | 2 | 2 | 1 | 1 |
| α(N+1) | 1 | 1 | 1 | ------ | 1 | 1 | 1 | 1 | 1 | 1 |
| β1 | 1 | 1 | 1 | ------ | 1 | 1 | 1 | 2 | 2 | 2 |
| β2 | N | 1 | 1 | ------ | 1 | 1 | 1 | 2 | 2 | 2 |
| β3 | 1 | N-1 | 1 | ------ | 1 | 1 | 1 | 2 | 2 | 2 |
| β4 | 1 | 1 | N-2 | ------ | 1 | 1 | 1 | 2 | 2 | 2 |
| ⋮ | ⋮ | ⋮ | ⋮ | ⋱ | ⋮ | ⋮ | ⋮ | ⋮ | ⋮ | ⋮ |
| β(N-2) | 1 | 1 | 1 | ------ | 4 | 1 | 1 | 2 | 2 | 2 |
| β(N-1) | 1 | 1 | 1 | ------ | 1 | 3 | 1 | 2 | 2 | 2 |
| βN | 1 | 1 | 1 | ------ | 1 | 1 | 2 | 2 | 2 | 2 |
| β(N+1) | 1 | 1 | 1 | ------ | 1 | 1 | 1 | 1 | 2 | 2 |
| ⋮ | ⋮ | ⋮ | ⋮ | ⋮ | ⋮ | ⋮ | ⋮ | ⋮ | ⋮ | ⋮ |
| ζ1 | 1 | 1 | 1 | ------ | 1 | 1 | 1 | 2 | 1 | N |
| ζ2 | N | 1 | 1 | ------ | 1 | 1 | 1 | 2 | 1 | N |
| ζ3 | 1 | N-1 | 1 | ------ | 1 | 1 | 1 | 2 | 1 | N |
| ζ4 | 1 | 1 | N-2 | ------ | 1 | 1 | 1 | 2 | 1 | N |
| ⋮ | ⋮ | ⋮ | ⋮ | ⋱ | ⋮ | ⋮ | ⋮ | ⋮ | ⋮ | ⋮ |
| ζ(N-2) | 1 | 1 | 1 | ------ | 4 | 1 | 1 | 2 | 1 | N |
| ζ(N-1) | 1 | 1 | 1 | ------ | 1 | 3 | 1 | 2 | 1 | N |
| ζN | 1 | 1 | 1 | ------ | 1 | 1 | 2 | 2 | 1 | N |
| ζ(N+1) | 1 | 1 | 1 | ------ | 1 | 1 | 1 | 1 | 1 | N |
| no ejection | N | N | N | ------ | N | N | N | N | N | N |

FIG.23

INK-JET PRINTER AND APPARATUS AND METHOD OF RECORDING HEAD FOR INK-JET PRINTER

BACKGROUND OF THE INVENTION

1. Field of the Invention

The present invention relates to an ink-jet printer for ejecting ink droplets through a droplet outlet orifice (a nozzle) and recording on paper and an apparatus and a method of driving a recording head for an ink-jet printer.

2. Description of the Related Art

Ink-jet printers for ejecting ink droplets through a droplet outlet orifice communicating with an ink chamber and recording on paper have been widely used. Ink droplet ejection has been controlled as follows in such ink-jet printers of related-art.

FIG. 1 is a schematic diagram of a recording head and a drive circuit thereof in a related-art ink-jet printer. As shown, a recording head 500 includes a nozzle 501 and a piezoelectric element 502 provided in correspondence with the nozzle 501. The piezoelectric element 502 is fixed to a wall of an ink chamber (not shown) to which ink is supplied through an ink duct (not shown). A drive signal 504 of a specific waveform is selectively inputted to the piezoelectric element 502 through an on/ off switch 503. That is, the drive signal 504 is only inputted to the piezoelectric element 502 when the switch 503 is turned on. On the application of the drive signal 504, the piezoelectric element 502 is bent in such a direction that the ink chamber volume is reduced. An ink droplet is thereby ejected through the nozzle 501.

For such printers, one of the methods for producing halftone images is varying a droplet size dot by dot. In the drive circuit of the recording head of related art shown in FIG. 1, however, only one type of drive signal is inputted to the piezoelectric element 502 so that whether to perform ejection or not is only controlled. Consequently, it is impossible to perform control for varying a size of ejected droplet from droplet to droplet although the interval between recorded dots is controlled. It is therefore difficult to faithfully achieve various image representations such as more natural halftone images.

SUMMARY OF THE INVENTION

It is an object of the invention to provide an ink-jet printer and an apparatus and a method of driving a recording head for an ink-jet printer for faithfully performing various image representations through ink droplet ejection by means of drive signals of different waveforms.

An ink-jet printer of the invention comprises: a droplet outlet orifice through which an ink droplet is ejected; a means for generating energy for having the ink droplet ejected through the outlet orifice; a means for generating a plurality of drive signals; and a means for selecting any of the drive signals in a time-division manner and supplying the signal to the means for generating energy.

Another ink-jet printer of the invention comprises: a droplet outlet orifice through which an ink droplet is ejected; a means for generating energy for having the ink droplet ejected through the outlet orifice; a means for generating a plurality of drive signals including a drive signal having a varying voltage waveform that disables ink droplet ejection in isolation from another waveform; and a means for selecting any of the drive signals in a time-division manner and supplying the signal to the means for generating energy.

An apparatus of the invention is provided for driving a recording head for an ink-jet printer including a droplet outlet orifice through which an ink droplet is ejected and a means for generating energy for having the ink droplet ejected through the outlet orifice. The apparatus comprises: a means for generating a plurality of drive signals and a means for selecting any of the drive signals in a time-division manner and supplying the signal to the means for generating energy.

Another apparatus of the invention is provided for driving a recording head for an ink-jet printer including a droplet outlet orifice through which an ink droplet is ejected and a means for generating energy for having the ink droplet ejected through the outlet orifice. The apparatus comprises: a means for generating a plurality of drive signals including a drive signal having a varying voltage waveform that disables ink droplet ejection in isolation from another waveform and a means for selecting any of the drive signals in a time-division manner and supplying the signal to the means for generating energy.

A method of the invention is provided for driving a recording head for an ink-jet printer including a droplet outlet orifice through which an ink droplet is ejected and a means for generating energy for having the ink droplet ejected through the outlet orifice. The method comprises the steps of: generating a plurality of drive signals and selecting any of the drive signals in a time-division manner and supplying the signal to the means for generating energy.

Another method of the invention is provided for driving a recording head for an ink-jet printer including a droplet outlet orifice through which an ink droplet is ejected and a means for generating energy for having the ink droplet ejected through the outlet orifice. The method comprises the steps of: generating a plurality of drive signals including a drive signal having a varying voltage waveform that disables ink droplet ejection in isolation from another waveform and selecting any of the drive signals in a time-division manner and supplying the signal to the means for generating energy.

According to the ink-jet printer and the apparatus and the method of driving a recording head for an ink-jet printer, the selection of the drive signal may be switched to another at a point between a cycle in which the ink droplet is ejected and the next cycle. The selection of the drive signal may be switched to another at any point including a point during a cycle in which the ink droplet is ejected.

Other and further objects, features and advantages of the invention will appear more fully from the following description.

BRIEF DESCRIPTION OF THE DRAWINGS

FIG. 10 is a table showing examples of waveforms composed with the drive signals shown in FIG. 9A and FIG. 9B.

FIG. 12 is a table showing examples of waveforms composed with the drive signals shown in FIG. 11A and FIG. 11B.

FIG. 14 is a table showing waveform composition based on a plurality of signals shown in FIG. 6A to FIG. 6D.

FIG. 16 is a table showing waveforms composed with the drive signals shown in FIG. 15A to FIG. 15C.

FIG. 20 is a table showing examples of waveforms composed with the drive signals shown in FIG. 19A and FIG. 19B.

FIG. 22 is a table showing examples of waveforms composed with the drive signals shown in FIG. 21A to FIG. 21C.

FIG. 23 is a table showing waveform composition based on a plurality of signals shown in FIG. 17A to FIG. 17D.

DETAILED DESCRIPTION OF THE PREFERRED EMBODIMENTS

Preferred embodiments of the invention will now be described in detail with reference to the accompanying drawings.

[First Embodiment]

Figure 3:
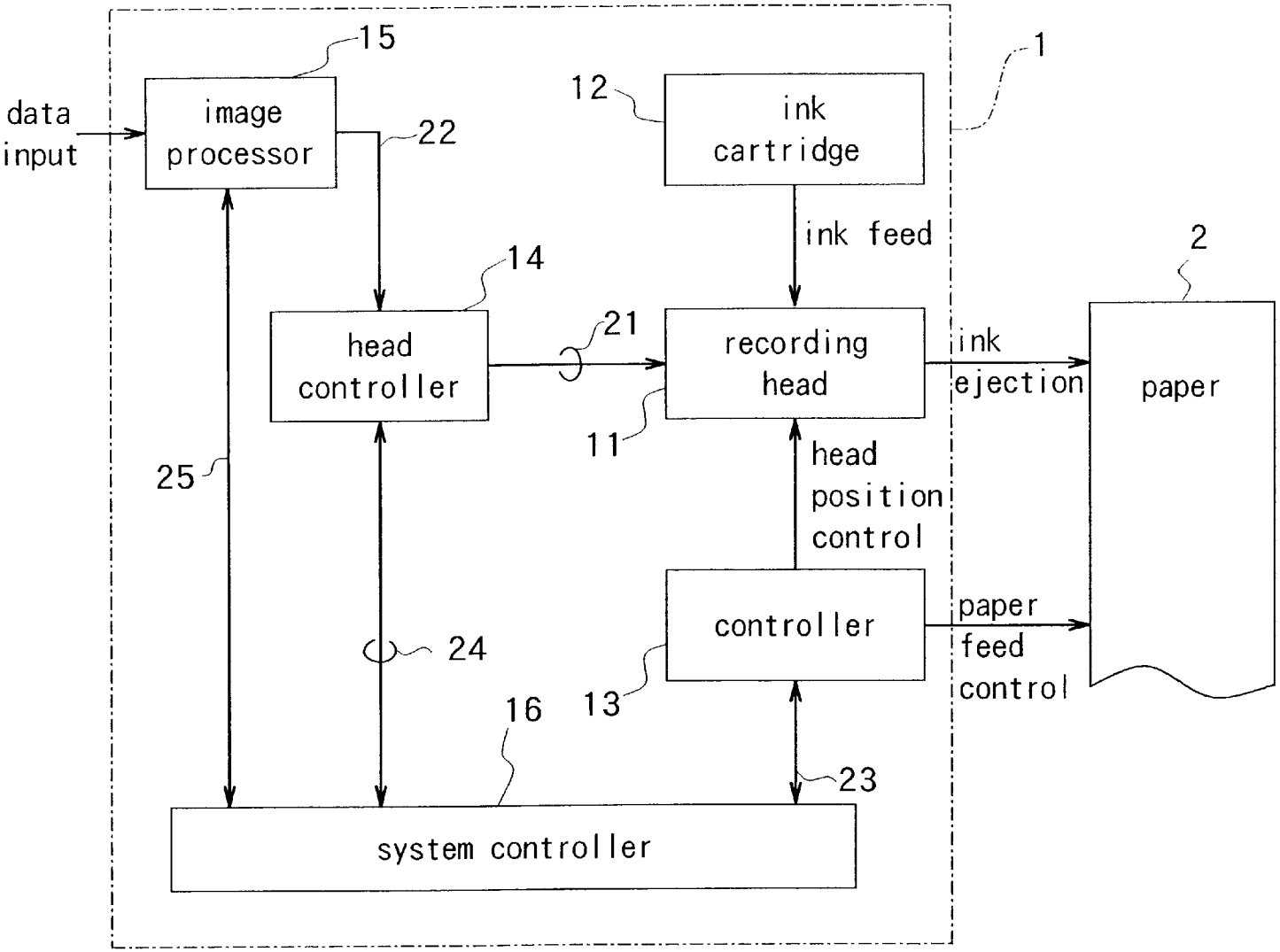
FIG. 3 is a block diagram of the ink-jet printer of the first embodiment of the invention.

FIG. 3 is a schematic diagram for illustrating the main part of an ink-jet printer of a first embodiment of the invention. Although a multi-nozzle head ink-jet printer having a plurality of nozzles will be described in the embodiment, the invention may be applied to a single-nozzle head ink-jet printer having a single nozzle. An apparatus and a method of driving a recording head of an ink-jet printer of the embodiment which are implemented with the ink-jet printer of the embodiment will be described as well.

An ink-jet printer 1 comprises: a recording head 11 for recording on recording paper 2 through ejecting ink droplets thereon; an ink cartridge 12 for feeding ink to the recording head 11; a controller 13 for controlling the position of the recording head 11 and feeding of the paper 2; a head controller 14 for controlling ink droplet ejection of the recording head 11 with a drive signal 21; an image processor 15 for performing a specific image processing on input image data and supplying the data as image printing data 22 to the head controller 14; and a system controller 16 for controlling the controller 13, the head controller 14 and the image processor 15 with control signals 23, 24 and 25, respectively.

Figure 4:
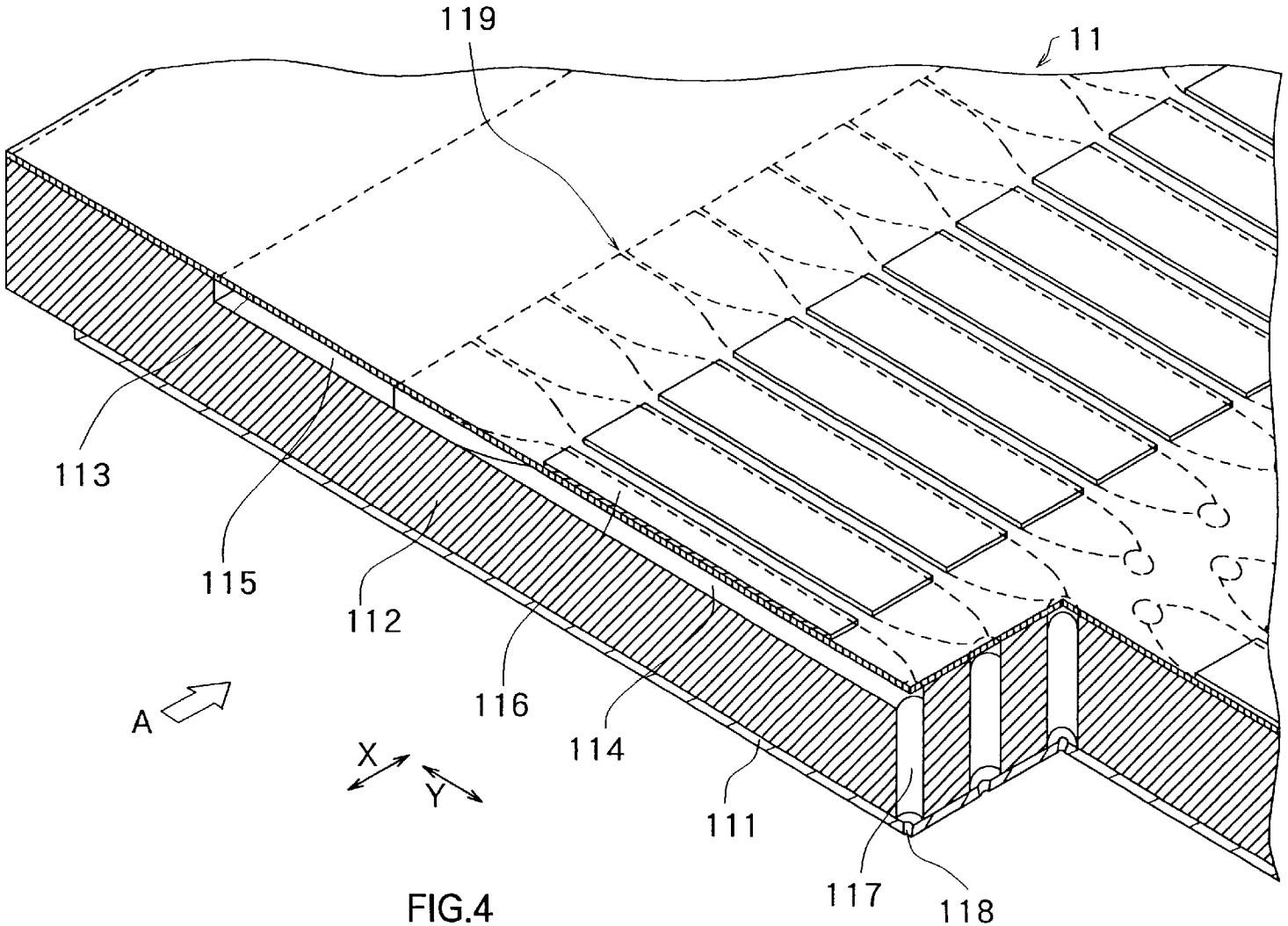
FIG.4 (PRIOR ART)
FIG. 4 is a perspective cross section of an example of recording head.
Figure 5:
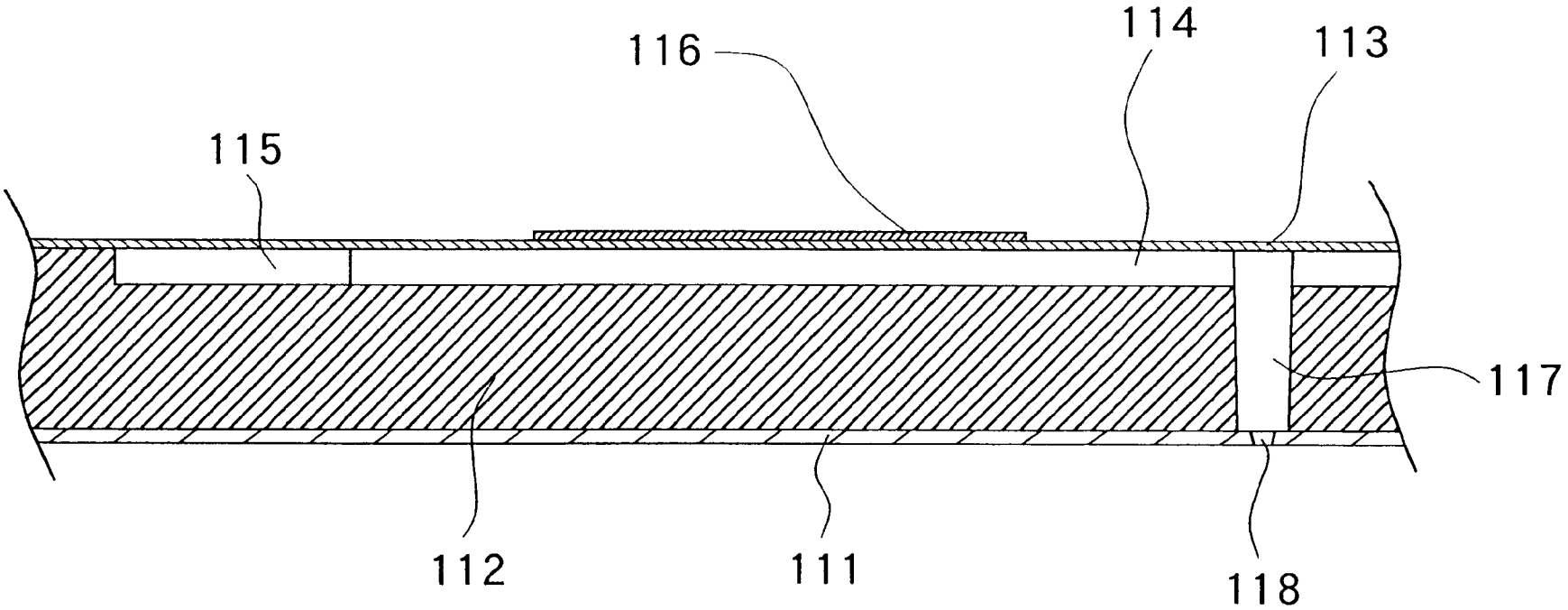
FIG.5 (PRIOR ART)
FIG. 5 is a cross section of the recording head.

FIG. 4 is a perspective cross section of the recording head 11 in FIG. 3. FIG. 5 is a cross section of the recording head 11 shown in FIG. 4 viewed in the direction of arrow A. As shown, the recording head 11 comprises a thin nozzle plate 111, a duct plate 112 stacked on the nozzle plate 111 and an oscillation plate 113 stacked on the duct plate 112. The plates are bonded to each other with an adhesive not shown, for example.

Concaves are selectively formed on the upper surface of the duct plate 112. The concaves and the oscillation plate 113 make up a plurality of ink chambers 114 and a shared duct 115 communicating with the ink chambers 114. Communicating sections 119 between the shared duct 115 and the ink chambers 114 are narrow. The width of the ink chambers 114 increases towards the direction opposite to the shared duct 115. Piezoelectric elements 116 are each fixed to the oscillation plate 113 directly above each ink chamber 114. Electrodes not shown are stacked on each piezoelectric element 116. A drive signal from the head controller 14 (FIG. 3) is applied to the electrodes. Each piezoelectric element 116 is thereby bent so as to increase (expand) and reduce (contract) the volume of each ink chamber 114. The piezoelectric element 116 corresponds to a "means for generating energy" of the invention.

The width of the section of each ink chamber 114 opposite to the side communicating with the shared duct 115 is reduced by degrees. At the end of the ink chamber 114, a duct hole 117 is formed through the thickness of the duct plate 112. The duct hole 117 communicates with a minute nozzle 118 formed in the nozzle plate 111 which is the lowest of the plates. An ink droplet is ejected through the nozzle 118. In the embodiment the recording head 11 has a plurality of nozzles 118 at even intervals in two rows along the direction (arrow X in FIG. 4) of feeding the paper 2 (FIG. 3). The nozzles 118 may be arranged in any other way such as in a single row. As shown in FIG. 4, the nozzles 118 in two rows are arranged such that one of the nozzles in one row is placed between neighboring two nozzles in the other row. Such a staggered arrangement of the nozzles in two rows allows a large number of nozzles placed in a small area. The size of the head as a whole is thereby reduced. The nozzle 118 corresponds to a "droplet outlet orifice" of the invention.

The shared duct 115 communicates with the ink cartridge 12 shown in FIG. 3 (not shown in FIG. 4 and FIG. 5). Ink is regularly fed into each ink chamber 114 at a constant speed from the ink cartridge 12 through the shared duct 115. Such ink feed may be performed by capillarity. Alternatively, a pressure mechanism may be provided for feeding ink by applying a pressure to the ink cartridge 12.

By a carriage drive motor and an associated carriage mechanism not shown, the recording head 11 is reciprocated in direction Y orthogonal to direction X in which the paper 2 is carried while ejecting ink droplets. An image is thereby recorded on the paper 2.

Figure 1:
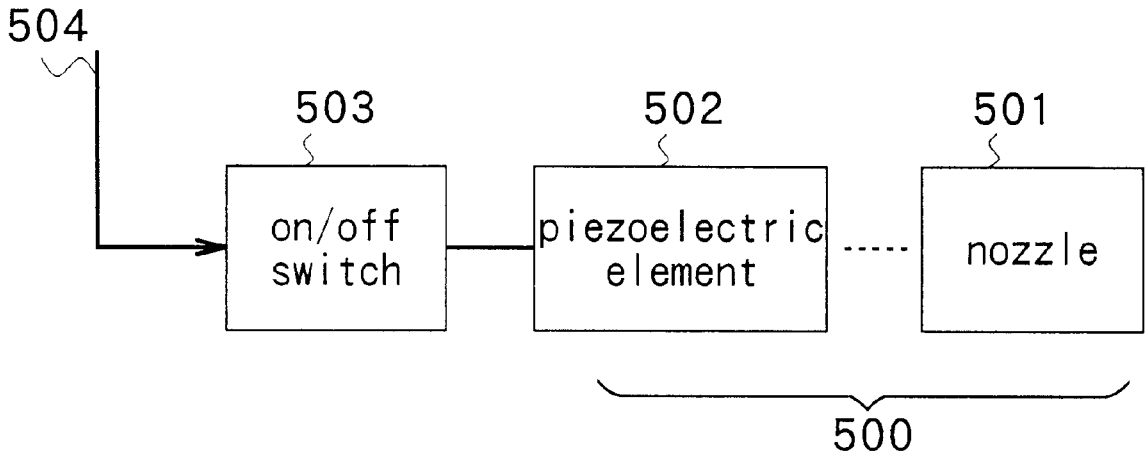
FIG.1 RELATED ART
FIG. 1 is a block diagram of a recording head and a drive circuit thereof in a related-art ink-jet printer.
Figure 2:
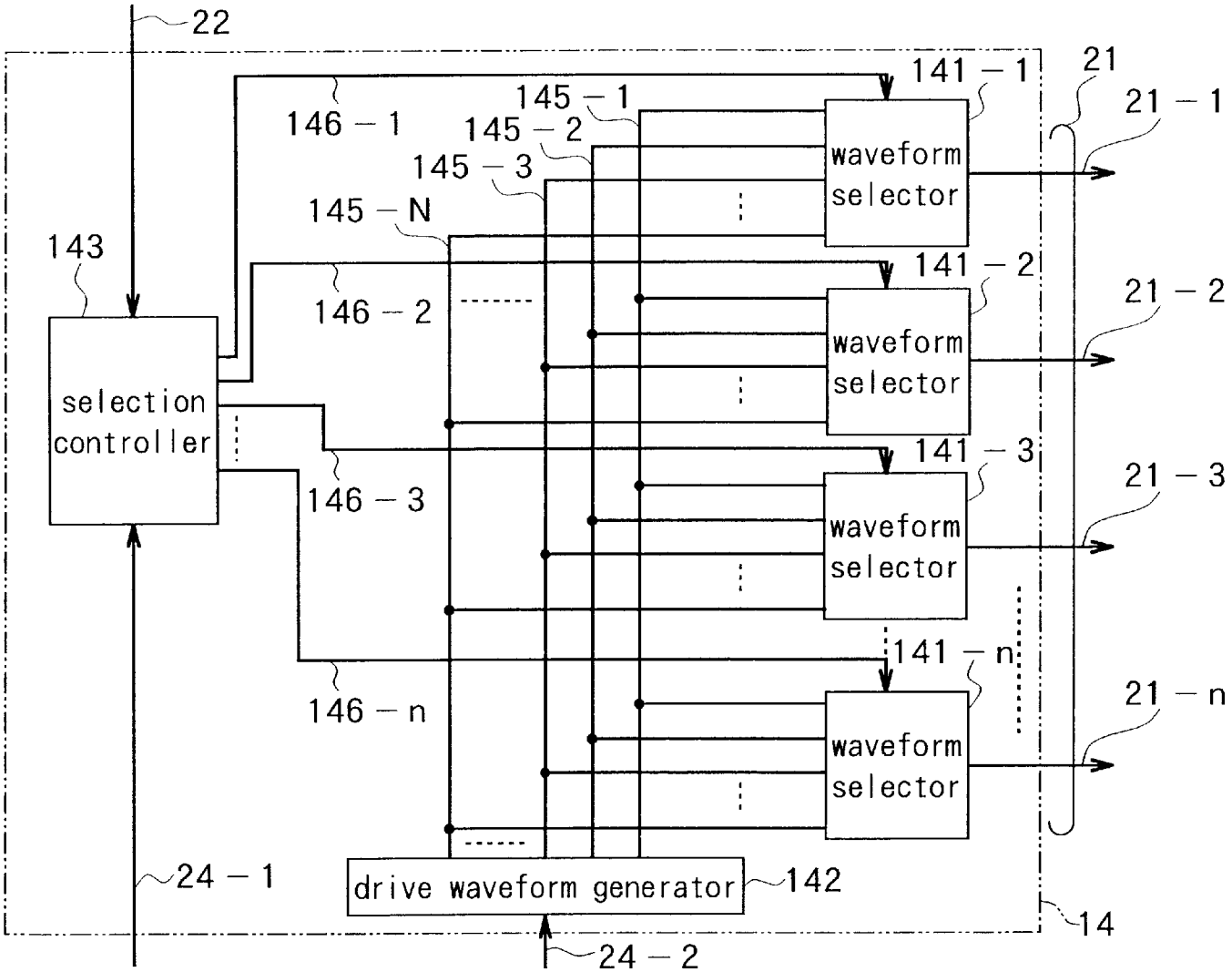
FIG. 2 is a block diagram of a head controller as a drive apparatus of a recording head for an ink-jet printer of a first embodiment of the invention.

FIG. 2 is a block diagram of the head controller 14 in FIG. 3. As shown, the head controller 14 comprises: a plurality of waveform selectors 141-1 to 141-n; a drive waveform generator 142 for generating drive signals 145-1 to 145-N having waveforms different from each other wherein the number of drive signals is "N"; and a selection controller 143 for controlling the operation of the waveform selectors 141-1 to 141-n. "N" and "n" each represent a positive integer.

The drive signals 145-1 to 145-N outputted from the drive waveform generator 142 are each branched into "n" in number to be inputted to the waveform selectors 141-1 to 141-n, respectively. The selection controller 143 inputs selection signals 146-1 to 146-n to the respective waveform selectors 141-1 to 141-n with specific timing. The waveform selectors 141-1 to 141-n each select one of the drive signals 145-1 to 145-N in accordance with the selection signal. The waveform selectors 141-1 to 141-n supply the selected drive signals to the recording head 11 as drive signals 21-1 to 21-n, respectively. The drive signals 21-1 to 21-n correspond to the drive signal 21 in FIG. 2. The waveform selectors 141-1 to 141-n each correspond to a "means for selecting" of the invention.

Although not shown, the drive waveform generator 142 may be made up of a microprocessor; a read only memory (ROM) for storing a program executed by the microprocessor; a random access memory (RAM) as a work memory used for particular computations performed by the microprocessor and temporary data storage and so on; a drive waveform storage section made up of nonvolatile memory; a digital-to-analog (D-A) converter for converting digital data read from the storage section into analog data; and an amplifier for amplifying an output of the D-A converter. The drive waveform storage section is provided for storing data indicating voltage waveforms of the drive signals 145-1 to 145-N for driving the recording head 11. The waveform data is read by the microprocessor and converted to analog signals by the D-A converter. The signals are amplified by the amplifier and outputted as the drive signals 145-1 to 145-N. The configuration of the drive waveform generator 142 is not limited to the one described above but may be implemented in any other way.

FIG. 6A to FIG. 6D show examples of one cycle of waveforms of the drive signals 145-1 to 145-N outputted from the drive waveform generator 142. FIG. 6A, FIG. 6B, FIG. 6C and FIG. 6D each show the drive signals 145-1, 145-2, 145-3 and 145-N, respectively. The vertical axis indicates voltage. The horizontal axis indicates time. Time proceeds from left to right in the graphs. Of the drive signals, the drive signal 145-N has a varying waveform whose undulation is too gentle to allow ink droplet ejection. That is, drive signal 145-N has a varying voltage waveform that disables ink droplet ejection in isolation from another waveform. On the other hand, the other drive signals 145-1 to 145-3 each have a waveform with a specific undulation that allows droplet ejection. The voltages of the drive signals 145-1 to 145-3 include 0 V and V2 (i) besides reference voltage V1 where i=1, 2, . . . or N.

As shown in FIG. 6A to FIG. 6D, both ends of the one cycle correspond to switching point ts at which the selected waveform is switched to another every cycle. The waveform selectors 141-1 to 141-n allow the selections of the drive signals to be switched to others at point ts between cycles as desired. In addition, the selections may be switched at a plurality of points ts' within the cycle. The periods into which the one cycle is divided with the switching points ts' are shown as $\tau$ 1 to $\tau$ M, started from the last one where M=5 when N=2 and M=N+2 when N is 3 or greater.

Figures 6A, 6B, 6C, 6D:
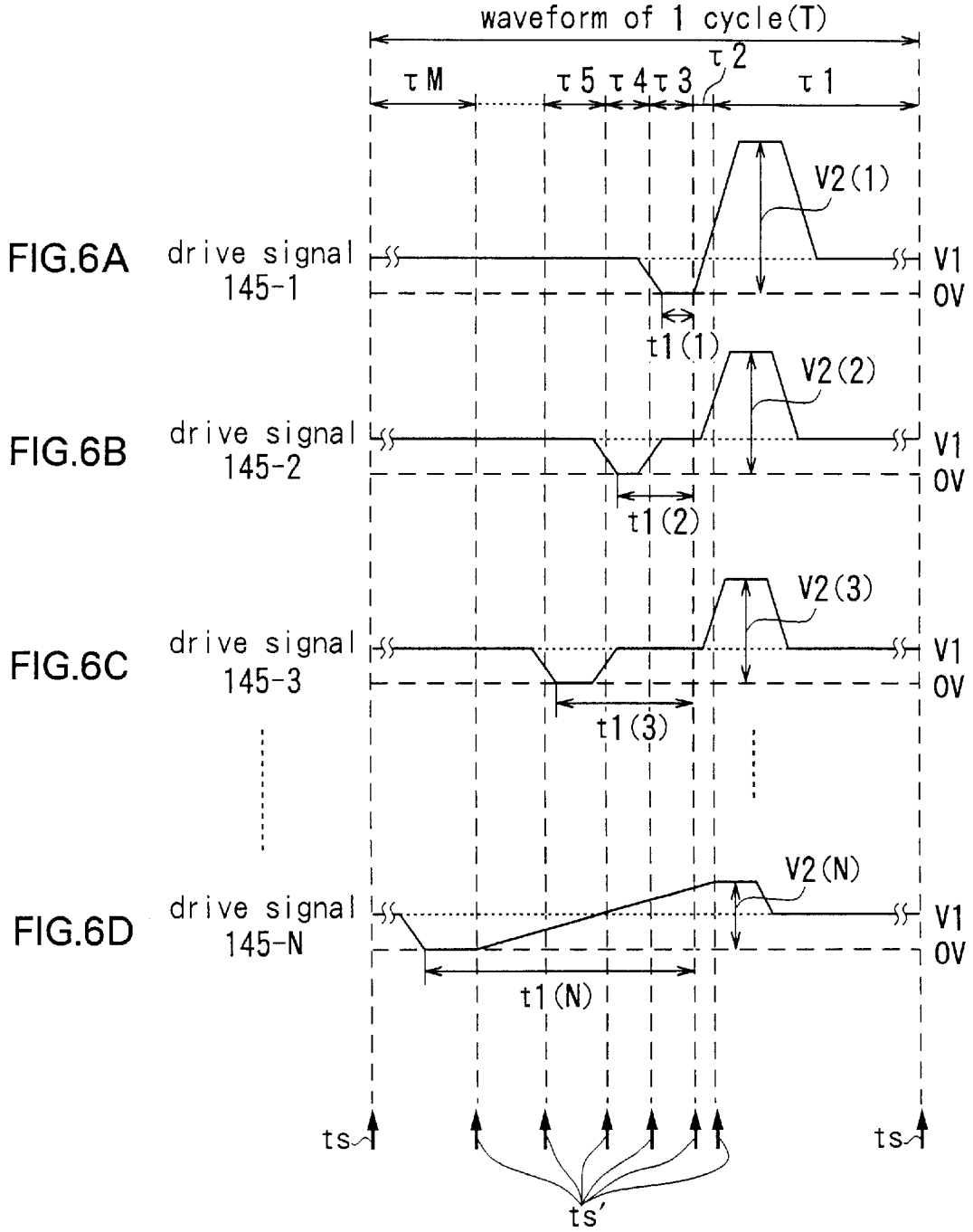
FIG. 6A to FIG. 6D show examples of drive signals outputted from the drive waveform generator shown in FIG. 2.
Figures 7A, 7B, 7C:
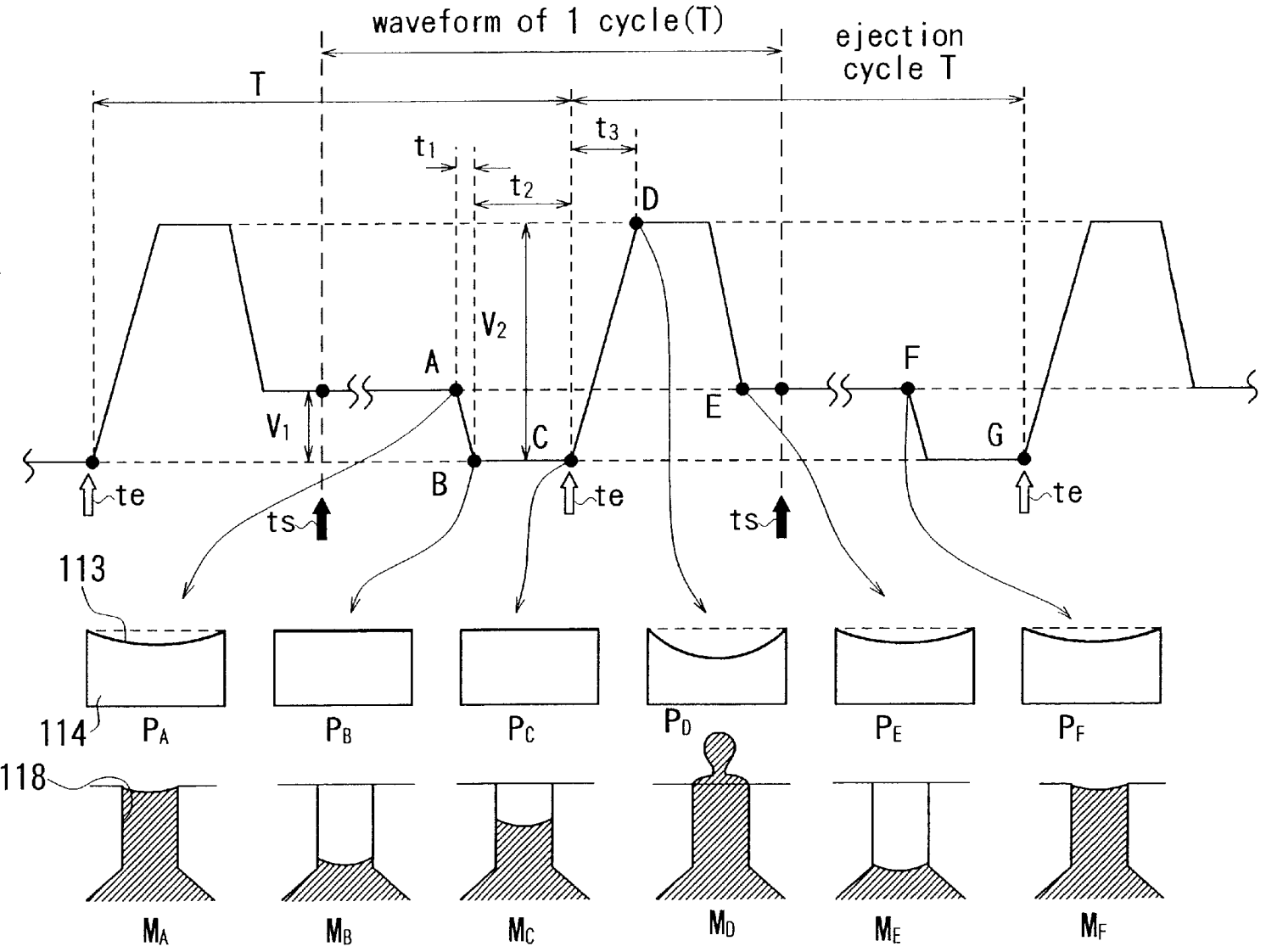
FIG. 7A to FIG. 7C show the relationship among the waveform of the drive signal shown in FIG. 6A, the state of ink chamber and a meniscus position in the nozzle.

Reference is made to FIG. 7A to FIG. 7C for describing the significance of the drive signal 145-1 shown in FIG. 6A. FIG. 7A to FIG. 7C show the relationship among the drive signal 145-1, the behavior of the piezoelectric element 116 and the position of extremity of ink in the nozzle 118 (referred to as meniscus position in the following description). FIG. 7A shows the waveform of the drive signal 145-1. The section divided with switching points ts corresponds to one cycle of the waveform. As shown in FIG. 6A to FIG. 6D, letters "ts" indicates the switching point provided for every cycle. FIG. 7B illustrates the changing state of the ink chamber 114 when the drive signal 145-1 having a waveform as shown in FIG. 7A is applied to the piezoelectric element 116 as it is. FIG. 7C illustrates the changing meniscus positions in the nozzle 118. For convenience of description, FIG. 7A illustrates a cyclic repetition of the drive signal 145-1 of the same waveform. The edge of the nozzle 118 (referred to as "nozzle edge" in the following description) is directed upward in FIG. 7C.

In FIG. 7A, a first step is the step in which a drive voltage is changed from first voltage V1 (constant) to the voltage of 0 V (from A to B). Time required for the first step is defined as t1. A second step is the step in which the voltage of 0 V is maintained to be on standby (from B to C). Time required for the second step is defined as t2. A third step is the step in which the voltage of 0 V is changed to second voltage V2 (from C to D). Time required for the third step is defined as t3. In the following description, first voltage V1 is called retraction voltage. Second voltage is called ejection voltage.

The recording head 11 is driven at a constant frequency (of the order of 1 to 10 kHz, for example). Cycle T of ink droplet ejection is determined, depending on the drive frequency. Points C and G and so on at which the third step is started are the points at which ejection is started (ejection start point "te"). The first and second steps precede the start of ejection.

At and before point A, as $P_A$ in FIG. 7B, the oscillation plate 113 is slightly bent inward with an application of voltage V1 to the piezoelectric element 116 and remains at rest. The ink chamber 114 is thereby brought to a state of contraction. At point A, as $M_A$ in FIG. 7C, the meniscus position in the nozzle 118 is equal to the nozzle edge .

Next, the first step is performed for reducing the drive voltage from voltage V1 at point A to the voltage of 0 V at point B. The voltage applied to the piezoelectric element 116 is thereby reduced to zero so that the bent in the oscillation plate 113 is eliminated and the ink chamber 114 is expanded as $P_B$ in FIG. 7B. Consequently, the meniscus in the nozzle 118 is retracted towards the ink chamber 114. At point B the meniscus is retracted as deep as $M_B$ in FIG. 7C, moving away from the nozzle edge.

The amount of retraction of the meniscus in the first step is changed by changing the potential difference between points A and B (retraction voltage V1). Therefore it is consequentially possible to adjust the meniscus position at the point of completion of the second step, that is, at the start point of the third step. The meniscus position, the distance between the nozzle edge and the meniscus at the start point of the third step, has a significant effect on a droplet size ejected in the third step. The droplet size is thus controlled by adjusting the meniscus position. Therefor, it is possible to control the droplet size by changing the amount of retraction of the meniscus (to be specific, retraction voltage V1) in the first step.

Next, the second step is performed for maintain the volume of the ink chamber 114 by fixing the drive voltage to zero so as to keep the oscillation plate 113 unbent during time t2 from point B to point C ($P_B$ to $P_C$ in FIG. 7C). During time t2 ink is continuously fed from the ink cartridge 12. The meniscus position in the nozzle 118 is thus shifted towards the nozzle edge. The meniscus position proceeds as far as the state of $M_C$ shown in FIG. 7C.

The amount of movement of the meniscus may be varied by changing time t2 in the second step. The meniscus position at the start point of the third step is thereby adjusted. That is, the droplet size is controllable by adjusting time t2.

Next, the third step is performed for abruptly increasing the drive voltage from the voltage of 0 V at point C to ejection voltage V2 at point D. Point C is ejection start point te as described above. Since high ejection voltage V2 is applied to the piezoelectric element 116 at point D, the oscillation plate 113 is greatly bent inward as $P_D$ in FIG. 7B. The ink chamber 114 is thereby abruptly contracted. Consequently, as $M_D$ in FIG. 7C, the meniscus in the nozzle 118 is pressed towards the nozzle edge at a stretch through which an ink droplet is ejected. The droplet ejected flies in the air and lands on the paper 2 (FIG. 3). The droplet size is reduced with an increase in the distance between the nozzle edge and the meniscus position at point C at which the third step is started.

Next, the drive voltage is reduced to V1 again so that the oscillation plate 113 is slightly bent inward to be in the initial state ($P_E$ in FIG. 7B). This state is maintained until point F at which the first step of the next ejection cycle is started. At point E immediately after the drive voltage is reduced to V1 again, as $M_E$ in FIG. 7C, the meniscus position is retreated by the amount nearly corresponding to the total of the volume of ink ejected and the increase in volume of the ink chamber 114. With ink refilling, the meniscus position returns to the position of the nozzle edge, as $M_F$ in FIG. 7C, at point F at which the first step of the next ejection cycle is started. This state is similar to $M_A$ at point A.

The cycle of ejection is thus completed. Such a cycle of operation is repeated for each of the nozzles 118 in a parallel manner. Image recording on the paper 2 (FIG. 3) is thereby continuously performed. The foregoing description of the steps (FIG. 7A to FIG. 7C) corresponds to the composite drive signal generated from the drive signals 145-1 to 145-N for the purpose of ejecting an ink droplet (such as waveforms α 1, α 2, β 1 and β 2 of the waveforms shown in FIG. 10 described below except "no ejection") as well.

Referring again to FIG. 6A to FIG. 6D, the characteristics of the waveforms of the drive signals 145-1 to 145-N will be described. As shown in FIG. 6A, the drive signals 145-1 has the waveform described with reference to FIG. 7A. As shown in FIG. 6B and FIG. 6C, the drive signals 145-2 to 145-(N−1) each have a waveform wherein the sections corresponding to the first and second steps in the drive signal 145-1 are gradually shifted to an earlier stage and the section between the sections corresponding to the second and third steps is maintained at constant voltage V1. To be specific, the drive signal 145-i is composed such that time t1(i) required for the second step after the waveform composition described later increases as suffix "i" increases. Ejection voltage V2 (i) decreases with an increase in suffix "i" of the drive signal 145-i. The drive signal 145-N has the waveform that changes from voltage V1 to 0 V before the earliest switching point ts' (the end of period τ M) among points ts' whose number is (M−1). The waveform gradually increases to V2 (N) towards the end of period τ 2 that starts at the point of start of ejection, that is, the start point of period τ 1. The drive signal does not allow ink droplet ejection.

The value of t1 (N), the maximum value of time required for the second step after waveform composition, is equal to or below the time required for the meniscus retracted in the first step to reach the nozzle edge. The minimum value of voltage to be a substantial ejection voltage in the third r: step (V2 (N)−V1) falls within the range that allows droplet ejection. The gradient of voltage variation in the section to be the third step is constant.

Attention being focused on time t1 (i) required for the second step in FIG. 6A to FIG. 6D (where i=1 to N−1), a drive signal to be composed with the drive signal with greater suffix "i" in ejects a droplet of greater size.

Attention being focused on voltage V2 (i) to be the ejection voltage, a drive signal to be composed with the drive signal with greater suffix "i" ejects a droplet of smaller size. Therefore, ink droplets of various sizes are ejected, as described later, by determining time t1 (i) required for the second step and voltage V2 (i) to be the ejection voltage, considering the appropriate balance between the two values and by applying the drive signal to the piezoelectric element of each nozzle while switching the selected drive signal to another at a point between cycles (that is, at switching points ts) and at specific points during the cycle (at switching points ts').

Figure 8:
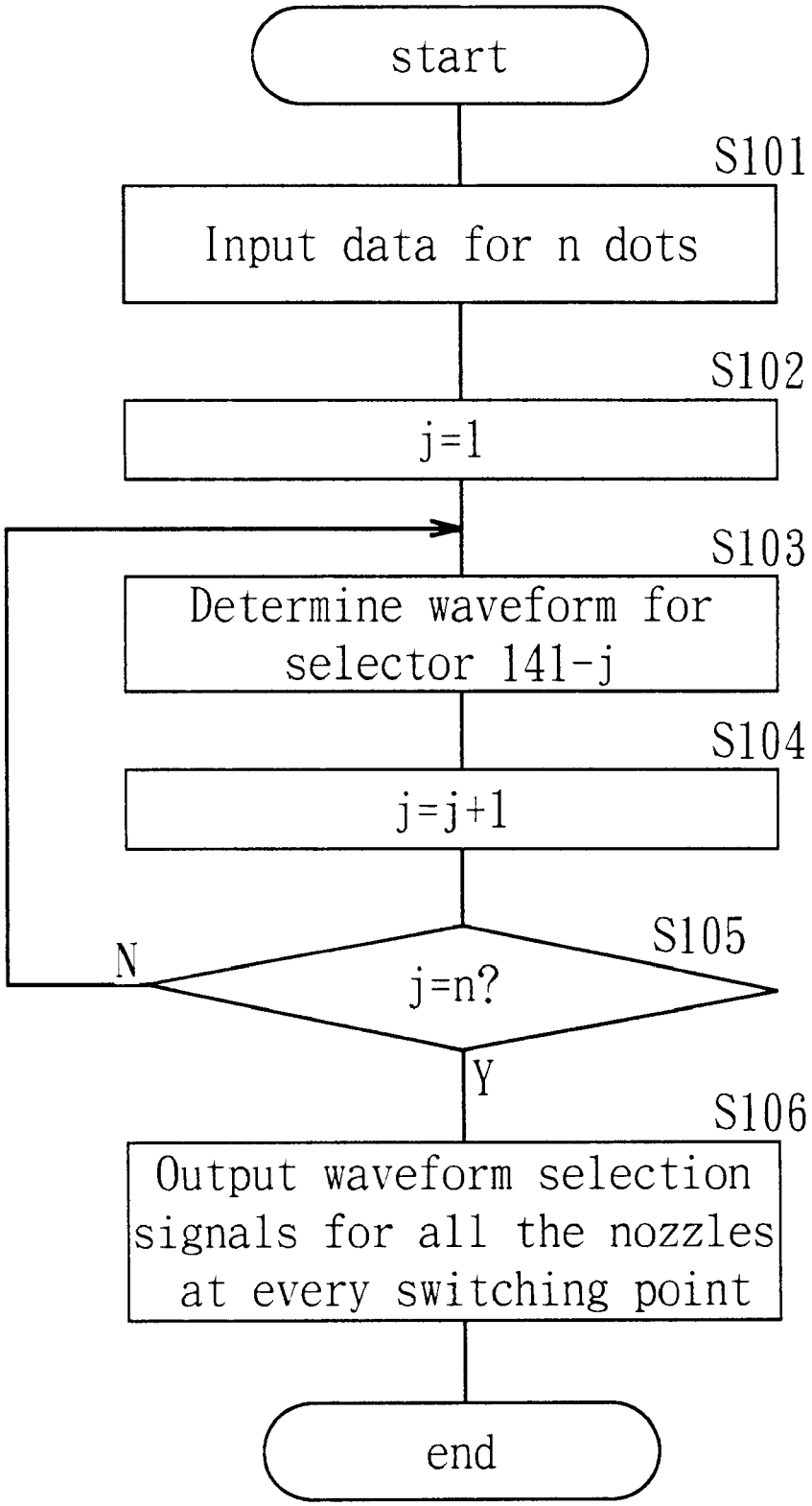
FIG. 8 is a flowchart for illustrating the main operation of the head controller.

Reference is now made to FIG. 8 for describing the operation of the ink-jet printer 1 shown in FIG. 2 as a whole. FIG. 8 shows the main operation of one ejection cycle in the head controller 14 (FIG. 2).

In FIG. 2, printing data is inputted to the ink-jet printer 1 from an information processing apparatus such as a personal computer. The image processor 15 performs specific image processing on the input data (such as expansion of compressed data) and outputs the data as the image printing data 22 to the head controller 14.

On receipt of the image printing data 22 of "n" dots corresponding to the number of nozzles of the recording head 11 (step S101 in FIG. 8), the controller 143 in the head controller 14 determines an ink droplet size for forming a dot for each nozzle 118 based on the image printing data 22. The controller 143 then determines drive signal waveforms to be selected at the waveform selectors 141-1 to 141-n based on the determined droplet sizes. To be specific, the controller 143 determines the drive signal waveform to be selected at the waveform selector 141ij while incrementing variable "j" from "1" to "n" (steps S102 to S105). The selected drive signal 145-1 to 145-N may be switched to another every cycle (at switching point ts) so as to use the original waveforms as they are. Alternatively, the selected drive signal 145-1 to 145-N may be switched to another at switching points ts' during the cycle so as to generate a composite waveform. Furthermore, the selected drive signal 145-1 to 145-N may be switched to another at both point between the cycles and points during the cycle. For example, a droplet of large size is selected for representing high density and a droplet of small size for representing low density or high resolution. For representing a delicate half-tone image, a droplet size slightly different from neighboring dots is selected. If there are variations in droplet ejection characteristics among the nozzles, the drive signal having a waveform for adjusting the variations may be selected.

Having determined the selection patterns of the drive signals for all the waveform selectors 141-1 to 141-n whose number is "n" (Y in step S105), the controller 143 outputs the waveform selection signals 146-1 to 146-n to the respective waveform selectors 141-1 to 141-n for selecting the drive signals having the determined waveforms. The controller 143 outputs the signals at switching points ts between the cycles or points ts' during the cycle, or both (step S106).

Based on the waveform selection signals 146-1 to 146-n inputted at the points described above, the waveform selectors 141-1 to 141-n selects the required one out of the drive signals 145-1 to 145-N to output. One of the drive signals 145-1 to 145-N having waveforms as shown in FIGS. 6A to 6D or the signal having the composite waveform is thereby supplied to the piezoelectric element 116 of each nozzle in the recording head 11 as the drive signal 21-1 to 21-n. The composite waveform is generated by switching the drive signals 145-1 to 145-N at points ts' during the cycle. In each nozzle of the recording head 11, the three steps described with reference to FIG. 7A to FIG. 7C are performed, based on the voltage waveform of the supplied drive signal. An ink droplet of size specified for each nozzle is thereby ejected.

When the nozzles 118 are arranged in two rows as shown in FIG. 4, droplet ejection is required to be performed with a specific time difference between the row comprising odd-numbered nozzles and the row comprising even-numbered nozzles so as to eject droplets through all the nozzles at one point in the direction of transporting the recording head 11. This is achieved by controlling the controller 143 to shift the output timing of the odd-numbered waveform selection signals 146-1, 146-3 and so on from the output timing of the even-numbered waveform selection signals 146-2, 146-4 and so on by the time corresponding to the time difference.

Figures 9A, 9B:
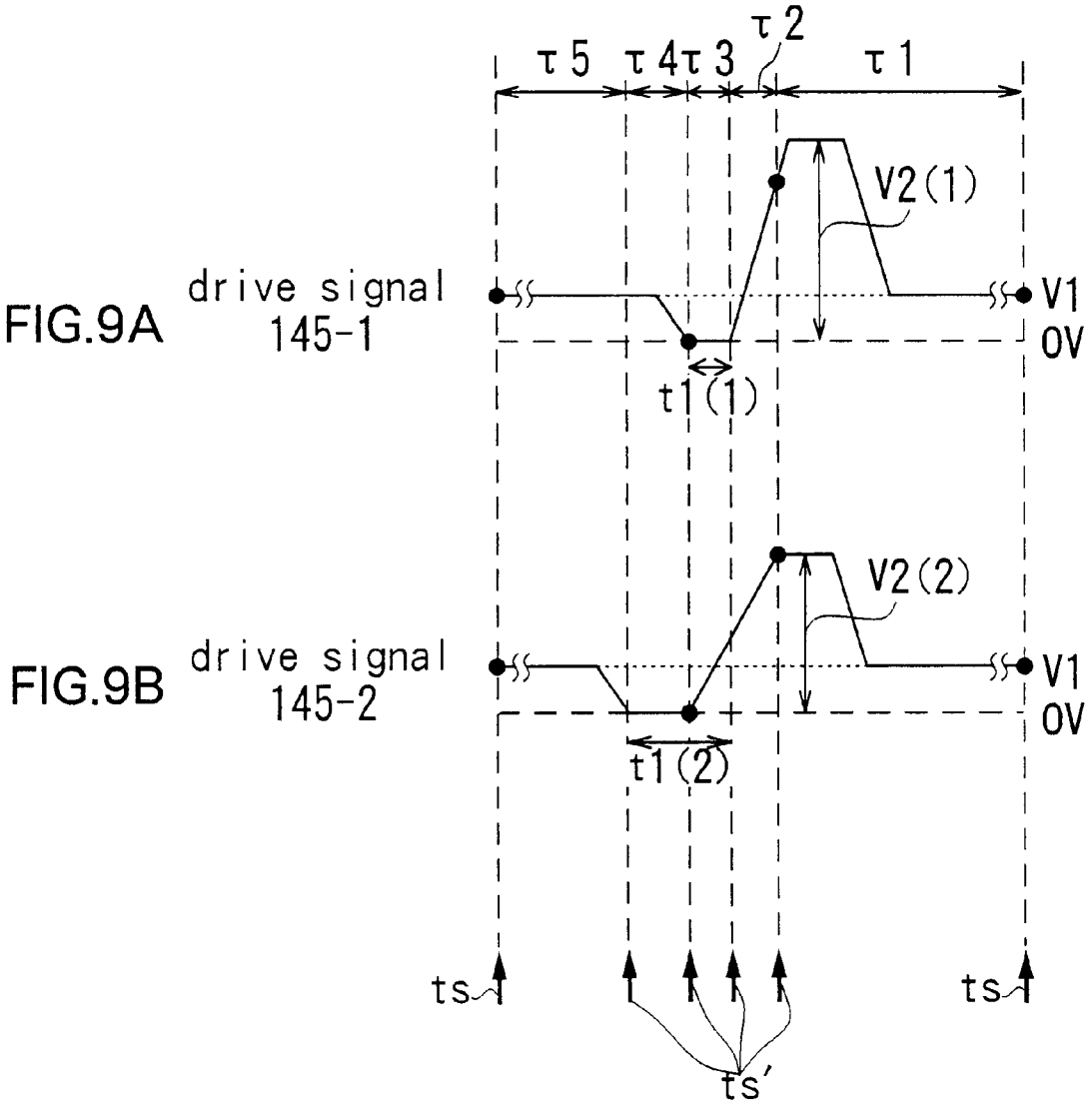
FIG. 9A and FIG. 9B show specific examples of the drive signals shown in FIG. 6A to FIG. 6D.

FIG. 9A and FIG. 9B show specific examples of drive signals outputted from the drive waveform generator 142 (FIG. 2) where the value of N of FIG. 6D is 2. In this example the generator 142 outputs two drive signals one of which is the drive signal 145-1 (FIG. 9A) and the other of which is the drive signal 145-2 (FIG. 9B) whose voltage is varying and whose undulation is too gentle to allow ink droplet ejection. Four switching points ts' are provided during the cycle so that the cycle is divided into five periods τ 1 to τ 5. That is, the two drive signals 145-1 to 145-2 are switched to each other not only at switching points ts between the ejection cycles but also at points ts' during the cycle.

In this example, as shown in FIG. 10, five types of drive voltage waveforms, more than the basic waveforms, are obtained by switching the selection of the drive signals 145-1 and 145-2 to output at switching points ts between the cycles and at points ts' during the cycle. In the table of FIG. 10, "1" and "2" in the columns of "τ 1 to τ 5 of waveform composition" mean that the drive signals 145-1 and 145-2 are selected, respectively. To be specific, waveform α 1 is composed through selecting the drive signal 145-2 for periods τ 5 and t 4 and the drive signal 145-1 for periods τ 3 to τ 1. Waveform α 2 is generated by selecting the drive signal 145-1 for all the periods. Waveform β 1 is composed through selecting the drive signal 145-2 for periods τ 5, τ 4 and τ 1 and the drive signal 145-1 for periods τ 3 and τ 2. Waveform β 2 is composed through selecting the drive signal 145-1 for periods τ 5 to τ 2 and the drive signal 145-2 for period τ 1. The waveform of "no ejection" is generated by selecting the drive signal 145-2 for all the periods. Therefore, waveforms α 1, β 1 and β 2 are newly generated composite waveforms. Waveform α 2 and the waveform of "no ejection" are the same as the original drive signals 145-1 and 145-2 shown in FIG. 9A and FIG. 9B, respectively. Waveforms α 1 and α 2 being compared with each other, time t1 (1) required for the second step of waveform α 2 is shorter than time t1 (2) required for the second step of waveform α 1. Consequently, the size of ejected droplet is smaller with waveform α 2. Similarly, the size of ejected droplet is smaller with waveform β 2 than with waveform β 1. In the waveform of "no ejection", as mentioned above, the value of voltage V2 (2) is low and the gradient from 0 V to voltage V2 (2) is gentle. Therefore, no droplet is ejected through the nozzle 118.

Figures 11A, 11B, 11C:
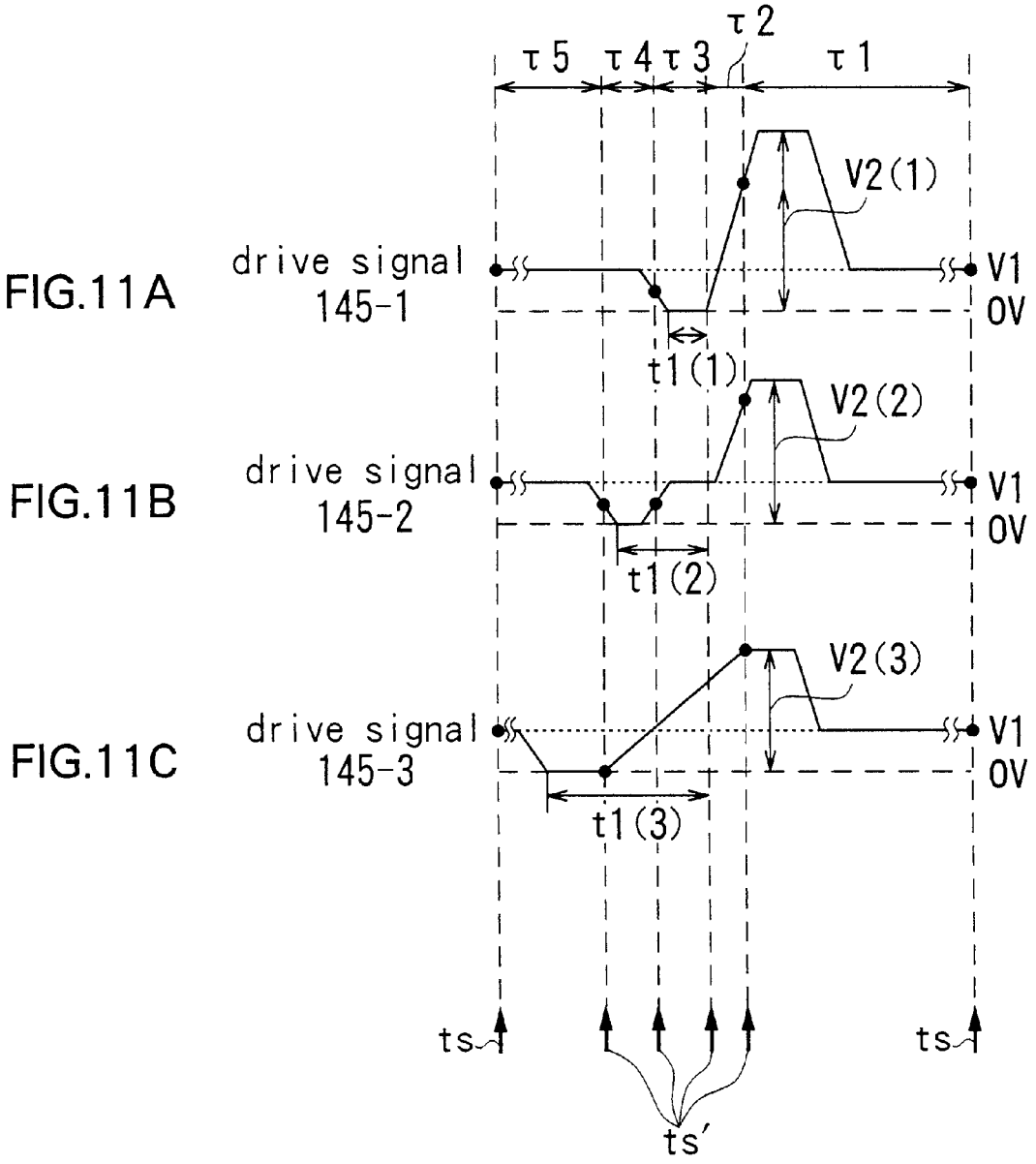
FIG. 11A to FIG. 11C show other examples of the drive signals shown in FIG. 6A to FIG. 6D.

FIG. 11A, FIG. 11B and FIG. 11C show other specific examples of drive signals outputted from the drive waveform generator 142 where the value of N of FIG. 6D is 3. In this example the generator 142 outputs three drive signals, that is, the drive signal 145-1 (FIG. 11A), the drive signal 145-2 (FIG. 11B) and the drive signal 145-3 (FIG. 11C). The drive signal 145-3 has a waveform whose voltage is varying and whose undulation is too gentle to allow ink droplet ejection. As in the previous example, four switching points ts' are provided during the cycle so that the cycle is divided into five periods τ 1 to τ 5. Thus, the three drive signals are switched to one another not only at switching points ts between the ejection cycles but also at points ts' during the cycle.

In this example, as shown in FIG. 12, thirteen types of drive voltage waveforms are obtained by switching the selection of the drive signals 145-1 to 145-3 to output at switching points ts between the cycles and at points ts' during the cycle. In the table of FIG. 12, "1", "2" and "3" in the columns of "τ 1 to τ 5 of waveform composition" mean that the drive signals 145-1, 145-2 and 145-3 are selected, respectively. For example, waveform α 1 is composed through selecting the drive signal 145-1 for periods τ 5, τ 4 and τ 1 and the drive signal 145-2 for periods τ 3 and τ 2. Waveform α 2 is composed through selecting the drive signal 145-3 for period τ 5, the drive signal 145-2 for period τ 4 and the drive signal 145-1 for periods τ 3 to τ 1. The rest of the waveforms are similarly composed. Waveform α 4 and the waveform of "no ejection" are the same as the basic drive signals 145-1 and 145-3, respectively.

With regard to the group consisting of waveforms α 2 to α 4, as shown in FIG. 12, the ejection voltage is V2 (1) and equal to each other while time t1 (i) required for the second step gradually decreases from waveform α 2 to waveform α 4. The size of ejected droplet thus decreases from waveform α 2 to waveform α 4. Similarly, with regard to the group consisting of waveforms β 2 to β 4, the ejection voltage is V2 (2) and equal to each other while time t1 (i) required for the second step gradually decreases from waveform β 2 to waveform β 4. The size of ejected droplet thus decreases from waveform β 2 to waveform β 4. This applies to the group consisting of waveforms γ 2 to γ 4 as well. In the example with reference to FIG. 12, however, the substantial ejection voltages of waveforms α 1, β 1 and γ 1 are (V2 (1)−V1), (V2 (2)−V1) and (V2 (3)−V1), respectively. It is therefore impossible to make a comparison univocally between the droplet size obtained with waveform α 1 and those obtained with waveforms α 2 to α 4, He between the droplet size obtained with waveform β 1 and those obtained with waveforms β 2 to β 4, and between the droplet size obtained with waveform γ 1 and those obtained with waveforms γ 2 to γ 4. However, the ejected droplet sizes are controllable as desired in the group of waveforms α 1 to α 4 by appropriately determining the balance between the ejection voltage (V2 (1)−V1) of waveform α 1 and the ejection voltage V2 (1) of waveforms α 2 to α 4 and time t1 (3), t1 (2) and t1 (1) required for the second step of waveforms α 2 to α 4, respectively. This applies to the group of waveforms β 1 to β 4 and waveforms γ 1 to γ 4 as well. The waveforms of the same suffix in the groups of waveforms α 1 to α 4, waveforms β 1 to β 4 and waveforms γ 1 to γ 4 being compared with one another, time t1 (i) required for the second step of the three groups is equal while ejection voltage V2 (i) gradually decreases from group α to group γ. The droplet size therefore decreases in this order.

In the example thus described with reference to FIG. 11A to FIG. 11C and FIG. 12, the three basic drive signals are switched to one another at the point between the cycles and the specific points during the cycle. As a result, thirteen types of drive signal waveforms, far more than the original signals, are generated.

Figures 13A, 13B, 13C, 13D:
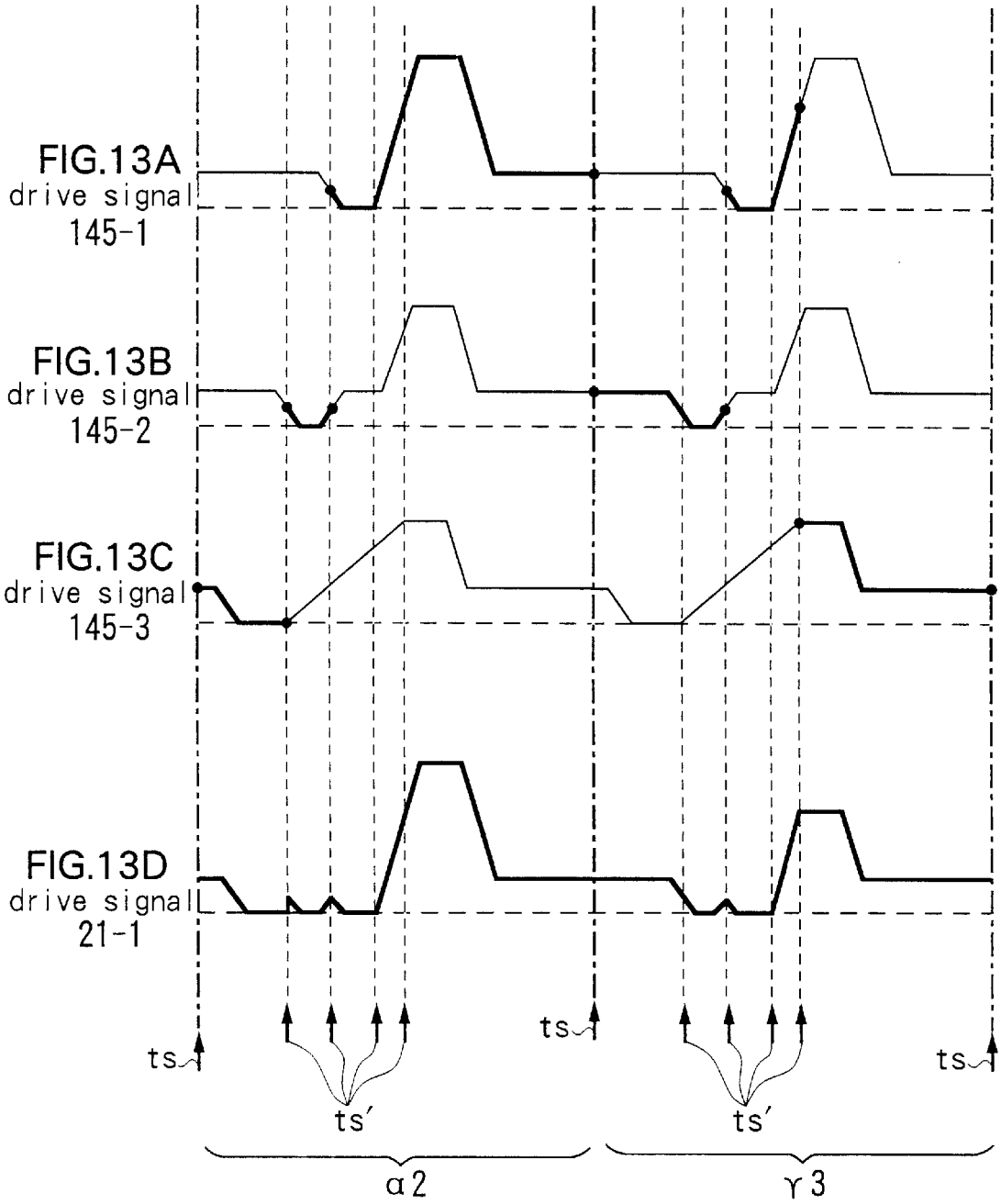
FIG. 13A to FIG. 13D show compositions of a new drive signal with the three drive signals shown in FIG. 11A to FIG. 11C.

FIG. 13A to FIG. 13C show examples of drive signals inputted to one of the waveform selectors (the selector 141-1, for example) where N=3. FIG. 13D shows an example of drive signal (drive signal 21-1) outputted from the waveform selector. FIG. 13A to FIG. 13C show the waveforms of the drive signals 145-1 to 145-3 inputted to the waveform selector 141-1. Of the waveforms shown in FIG. 13A to FIG. 13C, the sections selected by the waveform selector 141-1 are shown by heavy solid lines. A black dot indicates a point at which the signal is actually switched to another.

In this example, the selection of the drive signals 145-1 to 145-3 to output is switched at points ts between the cycles and points ts' during the cycle. Consequently, waveform α 2 is obtained as the drive signal 21-1 in the first cycle in FIG. 13D. Waveform γ 3 is obtained in the next cycle. In the following cycles, various types of waveforms are composed and outputted (not shown). Although FIG. 13D only shows the drive signal 21-1 as an example, other drive signals 21-2 to 21-n are similarly generated.

Attention being focused on one particular cycle, the waveforms of the drive signals 21-1 to 21-n are independent of each other. Ejection is thus independently performed in every nozzle in synchronization with ejection start point te. It is therefore possible to vary the sizes of droplets ejected through the nozzles from each other and to adjust variations among the nozzles by changing the drive waveforms in accordance with the ejection characteristics of the nozzles while synchronizing ejection performed in all the nozzles.

In the foregoing examples, waveform composition where N=2 and N=3 are described. More generally, waveforms whose number is [(N+1) N+1] are obtained by waveform composition using the basic waveforms of drive signals whose number is N, including a drive signal having a specific varying voltage waveform whose undulation does not allow ink droplet ejection. This principle of waveform composition will now be described in detail.

FIG. 14 shows a table of waveform composition wherein the basic waveforms of drive signals whose number is N are used (where N is 3 or above). In the table, "1", "2" "3", . . . and "N" in the columns of "τ 1 to τ M of waveform composition" mean that the drive signals 145-1, 145-2, 145-3, . . . and 145-N are selected, respectively.

As shown, composite waveforms belonging to the groups whose number is N from group α to group ζ and a waveform of "no ejection". The waveforms belonging to group α are all generated through selecting the drive signal 145-1 for period τ 1 of FIG. 6A. In group α, waveform α 1 is composed through selecting the drive signal 145-2 for periods τ 3 and τ 2 and the drive signal 145-1 for periods τ 4 to τ M. Waveforms α 2 to α (N+1) are all composed through selecting the drive signal 145-1 for period τ 2. For periods τ 3 to τ M, suffix "i" of the drive signal 145-i is incremented by one started from 1 along the diagonal line from the lower right to the upper left of the table.

The waveforms belonging to group β are all generated through selecting the drive signal 145-2 for period τ 1. The drive signals are selected in a manner similar to that of group α for the rest of the periods. The waveforms belonging to group ζ are all generated through selecting the drive signal 145-N for period τ 1. The drive signals are selected in a manner similar to that of group α for the rest of the periods.

The waveforms belonging to the rest of the groups are similarly composed. The groups from α to ζ whose number is N, each including (N+1) waveforms, are thus formed. The waveform of "no ejection" being added, the total of composite waveforms is [(N+1) N+1] as mentioned above.

With regard to the group consisting of waveforms α 2 to α (N+1) in FIG. 14, the ejection voltage is V2 (1) and equal to each other while time t1 (i) required for the second step gradually decreases from waveform α 2 to waveform α (N+1). The size of ejected droplet thus gradually decreases from waveform α 2 to waveform α (N+1). Similarly, with regard to the group consisting of waveforms β 2 to β (N+1), the ejection voltage is V2 (2) and equal to each other while time t1 (i) required for the second step gradually decreases from waveform β 2 to waveform β (N+1). The size of ejected droplet thus gradually decreases from waveform β 2 to waveform β (N+1). The same applies to the group consisting of waveforms ζ 2 to ζ (N+1) and the rest of the groups as well. In the example with reference to FIG. 14, however, the substantial ejection voltages of waveforms α 1, β 1, . . . and ζ 1 are (V2 (1)−V1), (V2 (2)−V1), . . . and (V2 (N)−V1), respectively. It is therefore impossible to make a comparison univocally between the droplet size obtained with waveform α 1 and those obtained with waveforms α 2 to α (N+1), between the droplet size obtained with waveform β 1 and those obtained with waveforms β 2 to β (N+1) and so on. The waveforms of the same suffix in the group of waveforms α 1 to α (N+1) to the group of waveforms ζ 1 to ζ (N+1) being compared with one another, time t1 (i) required for the second step of the groups is equal while ejection voltage V2 (i) gradually decreases from group α to group ζ. The droplet size therefore decreases from group α to group ζ.

Figures 15A, 15B, 15C:
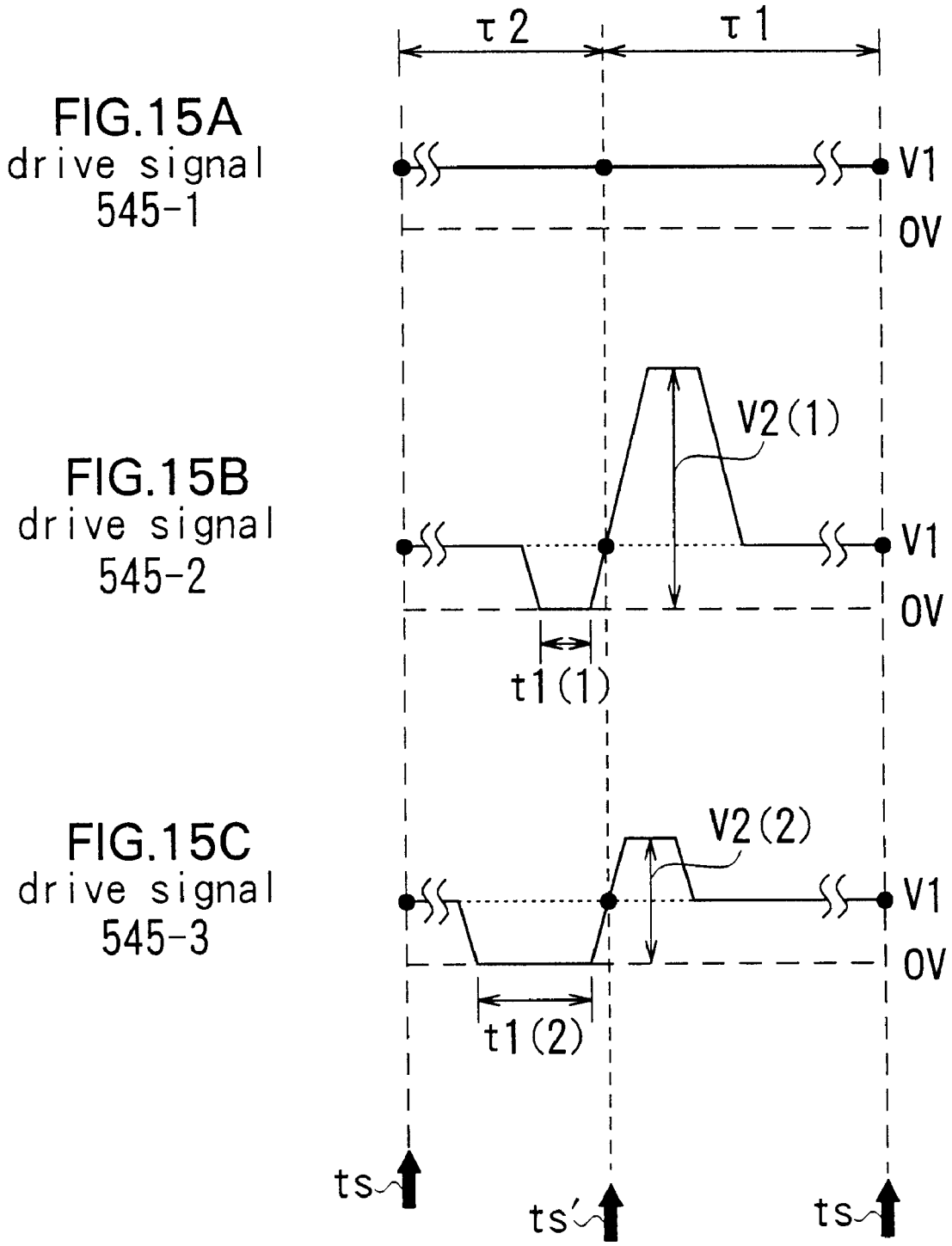
FIG. 15A to FIG. 15C show waveforms of drive signals of an example compared with the embodiment of the invention.

FIG. 15A to FIG. 15C and FIG. 16 show an example to be compared with the embodiment of the invention. FIG. 15A to FIG. 15C show the comparison example of drive signals outputted from the drive waveform generator 142 where N=3. In this comparison example, a drive signal 545-1 (FIG. 15A) having a constant voltage (V1) waveform which does not allow ink droplet ejection is used as a basic signal. In addition, drive signals 545-2 and 545-3 (FIG. 15B and FIG. 15C) having a varying undulation are used as basic signals. The selection of the three basic signals is switched not only at switching points ts between the ejection cycles but also at points ts' during the cycle.

In this example, seven types of drive voltage waveforms as shown in FIG. 16 are obtained by switching the selection of the drive signals 545-1 to 545-3 to output at switching points ts between the cycles and at points ts' during the cycle. In the table of FIG. 16, "1", "2" and "3" in the columns of "τ 1 and τ 2 of waveform composition" mean that the drive signals 545-1, 545-2 and 545-3 are selected, respectively. For example, waveform α 1 is composed through selecting τ 2, the first part of the drive signal 545-1 and τ 1, the latter part of the drive signal 545-2. Waveform α 2 is composed through selecting τ 2, the first part of the drive signal 545-3 and τ 1, the latter part of the drive signal 545-2. The rest of the waveforms are similarly composed. Waveforms α 3 and β 2 and the waveform of "no ejection" are the same as the basic drive signals 545-2, 545-3 and 545-1, respectively.

In contrast, the embodiment of the invention provides the waveform having a specific undulation as the waveform that does not allow ink droplet ejection instead of a constant voltage waveform. The undulation may have an effect on time t1 (i) required for the second step and ejection voltage V2 (i) in the third step. By using the waveform for waveform composition, the number of composite waveforms increases, compared with the above example where the constant voltage waveform is used as the waveform that does not allow droplet ejection (FIG. 15A to FIG. 15C and FIG. 16). When N=3, the seven types of waveforms are only obtained in the comparison example as shown in FIG. 16. In contrast, the thirteen types of waveforms are obtained in the embodiment as shown in FIG. 12. This is because the constant waveform does not contribute to composition of waveforms that allow droplet ejection when the constant waveform is used as the one that does not allow droplet ejection. In contrast, if the waveform with a specific undulation that does not allow ejection is used, part of the undulation may contribute to waveform composition. For example, in the comparison example in FIG. 16, only two waveforms α 1 and β 1 are composed through the use of the drive signal 545-1 of constant waveform. In contrast, in the example in FIG. 12, six waveforms α 2, β 2 and γ 1 to γ 4 are composed through the use of the basic drive signal 145-3. In the latter, the basic drive signal 145-3 contributes to composition of many new waveforms. That is, the number of basic waveforms being equal, the latter case allows composition of more drive signal waveforms and the types of droplet sizes are thereby increased. In other words, if the number of types of droplet sizes required is the same, fewer basic drive signals are necessary.

According to the embodiment described so far, waveforms far more than the basic waveforms are obtained. Consequently, control for various ink droplet ejection is achieved without generating many types of waveforms at the drive waveform generator 142. As a result, a load applied to the generator 142 as well as the head controller 14 is reduced.

[Second Embodiment]

A second embodiment of the invention will now be described.

In the embodiment, the drive waveform generator 142 shown in FIG. 2 generates and outputs drive signals 245-1 to 245-N having waveforms as shown in FIG. 17A to FIG. 17D instead of the drive signals 145-1 to 145-N shown in FIG. 6A to FIG. 6D. The remainder of the basic configurations are similar to those of the first embodiment. In the following description, the same reference numerals as those used in the first embodiment are used except the drive signals 245-1 to 245-N and other necessary cases.

FIG. 17A, FIG. 17B, FIG. 17C and FIG. 17D each show the drive signals 245-1, 245-2, 245-3 and 245-N, respectively. The vertical axis indicates voltage. The horizontal axis indicates time. Time proceeds from left to right in the graphs. The drive signals 245-1 to 245-N each have a waveform with a specific undulation. The voltages of the drive signals include voltage V1 and V2 (i) besides reference voltage 0 V where i=1, 2, . . . or N.

As shown in FIG. 17A to FIG. 17D, both ends of the one cycle correspond to switching point ts at which the selected waveform is switched to another every cycle. The waveform selectors 141-1 to 141-n allow the selections of the drive signals to be switched to others every cycle (at point ts). In addition, the selections may be switched at a plurality of points ts' within the cycle. The periods into which the one cycle is divided with the switching points ts' are shown as τ 1 to τ M, started from the last one where M=5 when N=2 and M=N+2 when N is 3 or greater.

Figures 17A, 17B, 17C, 17D:
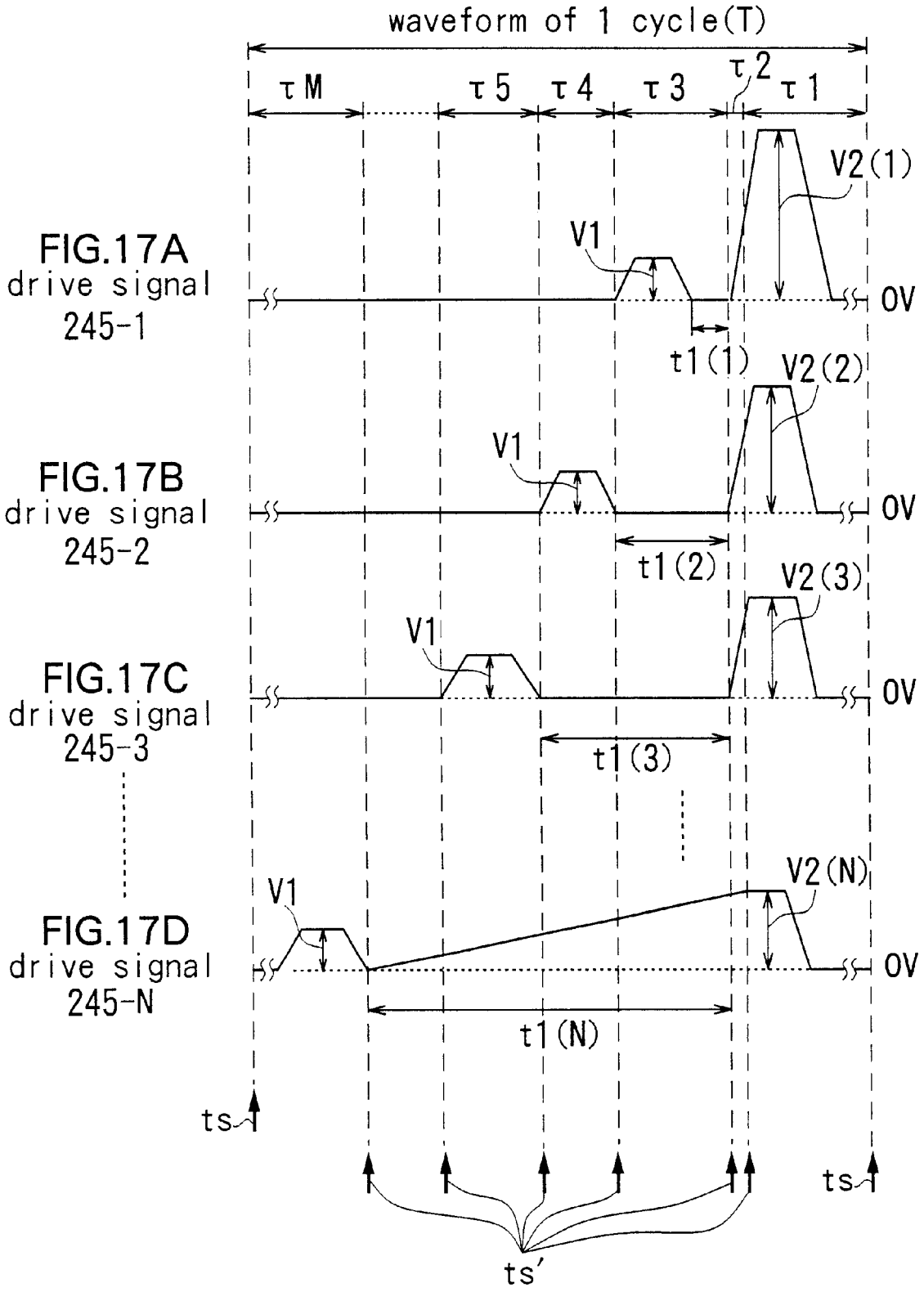
FIG. 17A to FIG. 17D show waveforms of drive signals used for an ink-jet printer, an apparatus and a method of driving a recording head for an ink-jet printer of a second embodiment of the invention.
Figures 18A, 18B, 18C:
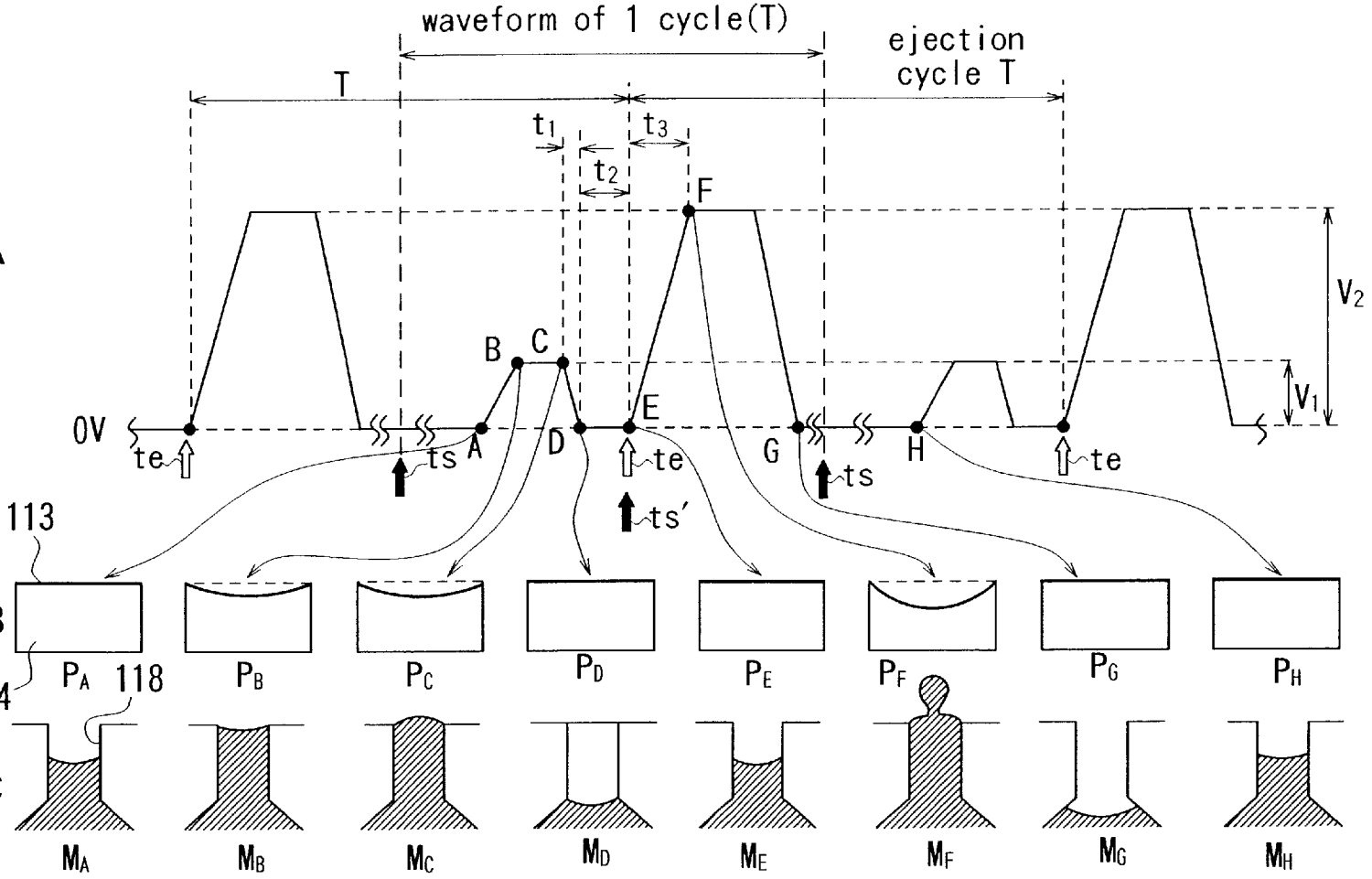
FIG. 18A to FIG. 18C show the relationship among the waveform of the drive signal shown in FIG. 17A, the state of ink chamber and a meniscus position in the nozzle.

Reference is now made to FIG. 18A to FIG. 18C for describing the significance of the drive signals 245-1 to 245-N. FIG. 18A to FIG. 18C correspond to FIG. 7A to FIG. 7C of the foregoing first embodiment. FIG. 18A to FIG. 18C show the relationship among the generalized waveform of the drive signals 245-1 to 245-N, the behavior of the piezoelectric element 116 and the meniscus position in the nozzle 118. FIG. 18A shows the waveform of the drive signal. The section divided with switching points ts corresponds to one cycle of the waveform. As shown in FIG. 17A to FIG. 17D, letters ts indicates the switching point provided for every cycle and ts' indicates the switching point during the cycle. FIG. 18B illustrates the changing state of the ink chamber 114 when the drive signal having a waveform as shown in FIG. 17A is applied to the piezoelectric element 116 as it is. FIG. 18C illustrates the changing meniscus positions in the nozzle 118. FIG. 18A illustrates a repetition of the drive signal of single type of waveform for convenience of description. The edge of the nozzle 118 is directed upward in FIG. 18C.

In FIG. 18A, a first preceding step is the step in which a drive voltage is changed from reference voltage 0 V to first voltage V1 (constant) (from A to B). A second preceding step is the step in which voltage V1 is maintained for a specific duration (from B to C). A first step is the step in which the drive voltage is changed from first voltage V1 to the voltage of 0 V (from C to D). Time required for the first step is defined as t1. A second step is the step in which the voltage of 0 V is maintained to be on standby (from D to E). Time required for the second step is defined as t2. A third step is the step in which the voltage of 0 V is changed to second voltage V2 (from E to F). Time required for the third step is defined as t3. In the following description, as in the first embodiment, first voltage V1 is called retraction voltage. Second voltage is called ejection voltage.

Point E and so on at which the third step is started are the points at which ejection is started (ejection start point te) as well as switching point ts'.

The first and second preceding steps and the first and second steps precede point E.

At and before point A, the voltage applied to the piezoelectric element 116 is 0 V. Therefore, as $P_A$ in FIG. 18B, the oscillation plate 113 is not bent and the volume of the ink chamber 114 is maximum. At point A, as $M_A$ in FIG. 18C, the meniscus position in the nozzle 118 retreats by a specific distance from the nozzle edge.

Next, the first preceding step is performed for gradually increasing the drive voltage from the voltage of 0 V at point A to voltage V1 at point B. The oscillation plate 113 is thereby bent inward and the ink chamber 114 is slightly contracted ($P_B$ in FIG. 18B). Since the contraction speed of the ink chamber 114 is slow, the reduction in volume of the ink chamber 114 allows the meniscus position in the nozzle 118 to advance and causes backflow of ink into the shared duct 115. The ratio of the amount of ink flowing forward to the amount flowing backward mainly depends on the flow passage resistance in the nozzle 118 and that in the communicating section 119 between the ink chamber 114 and the shared duct 115. By optimizing the ratio, the meniscus position at point B is controlled to almost reach the nozzle edge, as $M_B$ in FIG. 18C, without projecting from the nozzle edge.

Next, the second preceding step is performed for maintaining the volume of the ink chamber 114 constant by keeping the drive voltage at V1 from point B to point C. Since ink is continuously fed from the ink cartridge 12 during this step, the meniscus position in the nozzle 118 shifts towards the nozzle edge. At point C the meniscus position advances to the position slightly protruding from the nozzle edge as $M_C$ in FIG. 18C.

Next, the first step is performed for reducing the drive voltage from voltage V1 at point C to the voltage of 0 V at point D. The voltage applied to the piezoelectric element 116 is thereby reduced to zero so that the bend in the oscillation plate 113 is eliminated and the ink chamber 114 is expanded as $P_D$ in FIG. 18B. Consequently, the meniscus in the nozzle 118 is retracted towards the ink chamber 114. At point D the meniscus is retracted as deep as $M_D$ in FIG. 18C, that is, moves away from the nozzle edge.

As in the first embodiment, the amount of retraction of the meniscus in the first step is changed by changing the potential difference between points C and D (retraction voltage V1). It is thereby possible to control the droplet size.

Next, the second step is performed for maintaining the volume of the ink chamber 114 by fixing the drive voltage to zero so as to keep the oscillation plate 113 unbent during time t2 from point D to point E ($P_D$ to $P_E$ in FIG. 18C). During time t2 ink is continuously fed from the ink cartridge 12. The meniscus position in the nozzle 118 thus shifts towards the nozzle edge. The meniscus position proceeds as far as the state of $M_E$ shown in FIG. 18C.

As in the first embodiment, the amount of movement of the meniscus may be varied by changing time t2 in the second step. The meniscus position at the start point of the third step is thereby adjusted. Therefor, the droplet size is controllable by adjusting time t2.

Next, the third step is performed for abruptly increasing the drive voltage from the voltage of 0 V at point E to ejection voltage V2 at point F. Point E is ejection start point te as described above. At point F. the oscillation plate 113 is greatly bent inward as $P_F$ in FIG. 18B. The ink chamber 114 is thereby abruptly contracted. Consequently, as $M_F$ in FIG. 18C, the meniscus in the nozzle 118 is pressed towards the nozzle edge at a stretch through which an ink droplet is ejected. The droplet ejected flies in the air and lands on the paper 2 (FIG. 3).

Next, the drive voltage is reduced to 0 V again so that the oscillation plate 113 is unbent ($P_G$ in FIG. 18B). This state is maintained until point H at which the first preceding step of next ejection cycle is started. At point G immediately after the drive voltage is reduced to 0 V again, as $M_G$ in FIG. 18C, the meniscus position is retreated by the amount corresponding to the total of the volume of ink ejected and the increase in volume of the ink chamber 114. With ink refilling, the meniscus position shifts to the level similar to $M_A$ at initial point A, as $M_H$ in FIG. 18C, at point H at which the first preceding step of next ejection cycle is started.

The cycle of ejection is thus completed. Such a cycle of operation is repeated for each of the nozzles 118 in a parallel manner. Image recording on the paper 2 (FIG. 3) is thereby continuously performed.

Referring again to FIG. 17A to FIG. 17D, the characteristics of the waveforms of the drive signals 245-1 to 245-N will be described. The drive signal 245-i is composed such that time t1 (i) required for the second step after the waveform composition described later increases as suffix "i" increases. Resultingly, the drive signal 245-i is composed such that the steps indicated with points A to D in FIG. 18A are effected earlier. Ejection voltage V2 (i) to be the ejection voltage in the third step decreases with an increase in suffix "i" of the drive signal 245-i. The drive signal 245-N has the waveform that changes from voltage V1 to 0 V at earliest switching point ts' (the end of period τ M) among points ts' whose number is (M−1). The waveform gradually increases to V2 (N) towards the end of period τ 2 that starts at the point of start of ejection, that is, the start point of period τ 1. The drive signal does not allow ink droplet ejection.

The value of t1 (N), the maximum value of time required for the second step after waveform composition, is equal to or below the time required for the meniscus retracted in the first step to reach the nozzle edge. The minimum value V2 (N) of voltage to be the ejection voltage in the third step falls within the range that allows droplet ejection. The gradient of voltage variation in the periods to be the third steps are constant.

Attention being focused on time t1 (i) required for the second step in FIG. 17A to FIG. 17D, a drive signal to be composed with the drive signal with greater suffix "i" ejects a droplet of greater size. Attention being focused on voltage V2 (i) to be the ejection voltage, a drive signal to be composed with the drive signal with greater suffix "i" ejects a droplet of smaller size. Therefore, ink droplets of various sizes are ejected, as described later, by determining time t1 (i) required for the second step and voltage V2 (i) to be the ejection voltage, considering the appropriate balance between the two values and by applying the drive signal to the piezoelectric element of each nozzle while switching the selected drive signal to another every cycle (that is, at switching points ts) and at specific points during the cycle (at switching points ts').

Figures 19A, 19B:
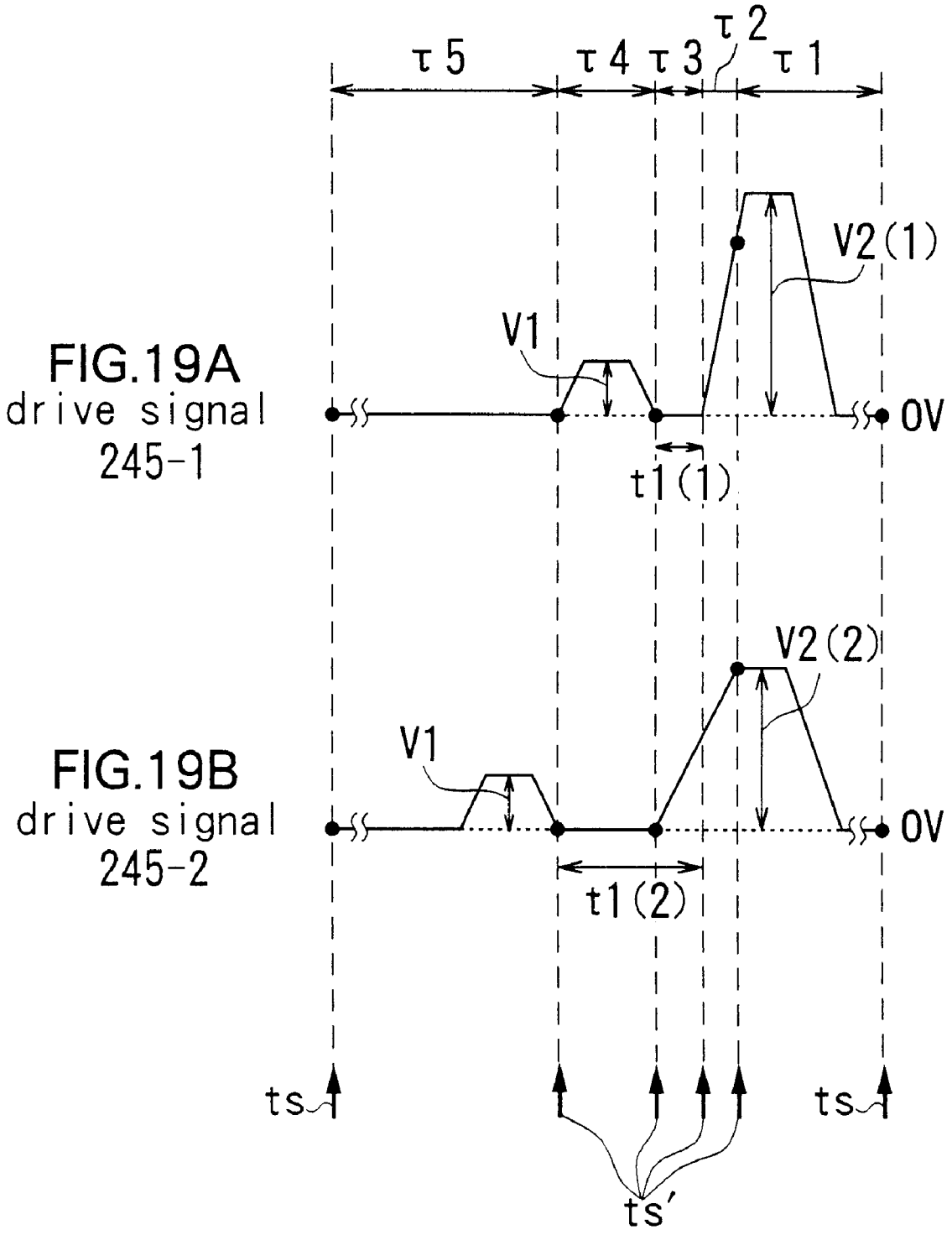
FIG. 19A and FIG. 19B show a specific example of the drive signals shown in FIG. 17A to FIG. 17D.

FIG. 19A and FIG. 19B show specific examples of drive signals outputted from the drive waveform generator 142 where the value of N of FIG. 17D is 2. In this example the generator 142 outputs two drive signals one of which is the drive signal 245-1 (FIG. 19A) and the other of which is the drive signal 245-2 (FIG. 19B) whose voltage is varying and whose undulation is too gentle to allow ink droplet ejection. Four switching points ts' are provided during the cycle so that the cycle is divided into five periods τ 1 to τ 5. That is, the two drive signals 245-1 and 245-2 are switched to each other not only at switching points ts between the ejection cycles but also at points ts' during the cycle.

In this example, as shown in FIG. 20, seven types of drive voltage waveforms, more than the basic waveforms, are obtained by switching the selection of the drive signals 245-1 and 245-2 to output at switching points ts between the cycles and at points ts' during the cycle. In the table of FIG. 20, "1" and "2" in the columns of "τ 1 to τ 5 of waveform composition" mean that the drive signals 245-1 and 245-2 are selected, respectively. To be specific, waveform α 1 is composed through selecting the drive signal 245-2 for period τ 4 and the drive signal 245-1 for the rest of the periods.

Waveform α 2 is generated by selecting the drive signal 245-2 for periods τ 5 and τ 4 and the drive signal 245-1 for the rest of the periods. Waveform α 3 is generated by selecting the drive signal 245-1 for all the periods.

Waveforms β 1 to β 3 are similarly composed. The waveform of "no ejection" is generated by selecting the drive signal 245-2 for all the periods.

Therefore, waveforms α 1, α 2 and β 1 to β 3 are new composite waveforms. Waveform α 3 and the waveform of "no ejection" are the same as the original drive signals 245-1 and 245-2 shown in FIG. 19A and FIG. 19B, respectively. With regard to group α, ejection is performed without retracting the meniscus with waveform α 1. Time t1 (1) required for the second step of waveform α 3 is shorter than time t1 (2) required for the second step of waveform α 2. Consequently, the size of ejected droplet decreases from waveform α 1 to waveform α 3. Similarly, with regard to group β, the size of ejected droplet decreases from waveform β 1 to waveform β 3. In the waveform of "no ejection", the value of voltage V2 (2) is low and the gradient from 0 V to voltage V2 (2) is gentle. Therefore, no droplet is ejected through the nozzle 118.

Figure 21:
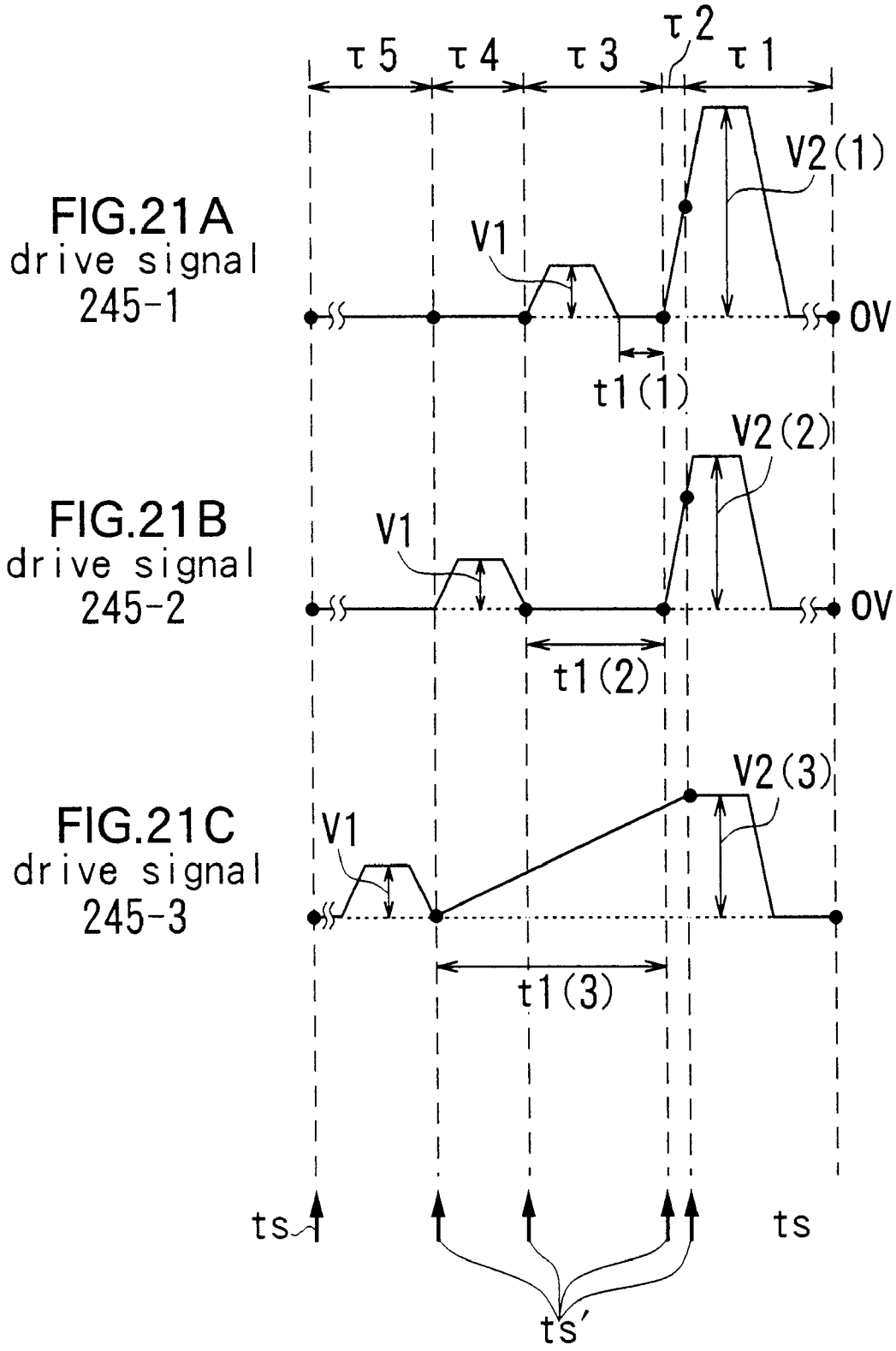
FIG. 21A to FIG. 21C show other examples of the drive signals shown in FIG. 17A to FIG. 17D.

FIG. 21A, FIG. 21B and FIG. 21C show other specific examples of drive signals outputted from the drive waveform generator 142 where the value of N of FIG. 17D is 3. In this example the generator 142 outputs three drive signals, that is, the drive signal 245-1 (FIG. 21A), the drive signal 245-2 (FIG. 21B) and the drive signal 245-3 (FIG. 21C). Four switching points ts' are provided during the cycle so that the cycle is divided into five periods τ 1 to τ 5. That is, the three drive signals are switched to one another not only at switching points ts between the ejection cycles but also at points ts' during the cycle.

In this example, as shown in FIG. 22, thirteen types of drive voltage waveforms are obtained by switching the selection of the drive signals 245-1 to 245-3 to output at switching points ts between the cycles and at points ts' during the cycle. In the table of FIG. 22, "1", "2" and "3" in the columns of "τ 1 to τ 5 of waveform composition" mean that the drive signals 245-1, 245-2 and 245-3 are selected, respectively. Waveforms α 4 and β 3 and the waveform of "no ejection" are the same as the basic drive signals 245-1, 245-2 and 245-3, respectively.

With regard to the group consisting of waveforms α 1 to α 4, as shown in FIG. 22, the size of ejected droplet decreases from waveform α 1 to waveform α 4. Similarly, with regard to the group consisting of waveforms β 1 to β 4, the size of ejected droplet decreases from waveform β 1 to waveform β 4. With regard to the group consisting of waveforms γ 1 to γ 4, the size of ejected droplet decreases from waveform γ 1 to waveform γ 4. The waveforms of the same suffix in the groups of waveforms α 1 to α 4, waveforms β 1 to β 4 and waveforms γ 1 to γ 4 being compared with one another, the droplet size decreases from group α to group γ.

In the example thus described with reference to FIG. 21A to FIG. 21C and FIG. 22, the three basic drive signals are switched to one another at the point between the cycles and the specific points during the cycle. As a result, thirteen types of drive signal waveforms, far more than the original signals, are generated.

In the foregoing examples (FIG. 19A to FIG. 22), waveform composition where N=2 and N=3 are described. More generally, waveforms whose number is [(N+1) N+1] are obtained by waveform composition using the basic waveforms of drive signals whose number is N, including a drive signal having a specific varying voltage waveform whose undulation does not allow ink droplet ejection. This principle of waveform composition will now be described in detail.

FIG. 23 shows a table of waveform composition wherein the basic waveforms of drive signals whose number is N are used. In the table, "1", "2", "3", . . . and "N" in the columns of "τ 1 to τ M of waveform composition" mean that the drive signals 245-1, 245-2, 245-3, . . . and 245-N are selected, respectively.

As shown, composite waveforms belonging to the groups whose number is N from group α to group ζ and a waveform of "no ejection" are * generated. The waveforms belonging to group α are all generated through selecting the drive signal 245-1 for periods τ 2 and τ 1. Waveforms α 1 to α N are all composed through selecting the drive signal 245-2 for period τ 3. For periods τ M to τ 4, suffix "i" of the drive signal 245-i is incremented by one from 2 to N along the diagonal line of the table from the lower right to the upper left with period τ 4 of waveform α N as the starting point. For the rest of the periods the drive signal 245-1 is selected. Waveform α (N+1) is generated through selecting the drive signal 245-1 for periods τ M to τ 3.

The waveforms belonging to group β are all generated through selecting the drive signal 245-2 for periods τ 2 and τ 1. The drive signals are selected in a manner similar to that of group α for the rest of the periods. The waveforms belonging to group ζ are all generated through selecting the drive signals 245-1 and 245-N for periods τ 2 and τ 1, respectively. The drive signals are selected in a manner similar to that of group α for the rest of the periods.

The waveforms belonging to the rest of the groups are similarly composed. The groups from α to ζ whose number is N, each including (N+1) waveforms, are thus formed. The waveform of "no ejection" being added, the total of composite waveforms is [(N+1) N+1] as mentioned above.

With regard to the group consisting of waveforms α 1 to α (N+1) in FIG. 23, the ejection voltage is V2 (1) and equal to each other while the meniscus is not retracted with waveform α 1. In addition, time t1 (i) required for the second step gradually decreases from waveform α 2 to waveform α (N+1). The size of ejected droplet thus gradually decreases from waveform α 1 to waveform α (N+1). Similarly, with regard to the group consisting of waveforms β 1 to β (N+1), the size of ejected droplet gradually decreases from waveform β 1 to waveform β (N+1). The same applies to the group consisting of waveforms ζ 1 to ζ (N+1) and the rest of the groups as well. The waveforms of the same suffix in the group of waveforms α 1 to α (N+1) to the group of waveforms ζ 1 to ζ (N+1) being compared with one another, time t1 (i) required for the second step of the groups is equal while ejection voltage V2 (i) gradually decreases from group α to group ζ. The droplet size therefore decreases from group α to group ζ.

According to the second embodiment described so far, waveforms far more than the basic waveforms are obtained, too. Consequently, control for various ink droplet ejection is achieved without generating many types of waveforms at the drive waveform generator 142. As a result, a load applied to the generator 142 as well as the head controller 14 is reduced.

The invention is not limited to the embodiments described so far but may be practiced in still other ways. For example, although the drive signals shown in FIG. 6A to FIG. 6D and FIG. 17A to FIG. 17D are used as the basic waveforms, signals having any other waveform may be applied.

Although the foregoing embodiments provide waveform selection and composition focusing on control of ink droplet sizes, waveform selection and composition focusing on control of droplet velocity may be performed. Furthermore, both droplet sizes and velocity may be controlled.

Although drive signal selection is switched at not only points between the ejection cycles but also points during the cycle, selection may be switched at either of the former points and the latter points. However, more waveforms are obtained by switching at both points.

Obviously many modifications and variations of the present invention are possible in the light of the above teachings. It is therefore to be understood that within the scope of the appended claims the invention may be practiced otherwise than as specifically described.

What is claimed is:

1. An ink-jet printer comprising:

a droplet outlet orifice through which an ink droplet is ejected;

means for generating energy for ejecting the ink droplet through the outlet orifices;

means for generating a plurality of drive signals; and means for selecting a drive signal from the plurality of drive signals in a time-division manner where a waveform of a cycle T is divided into switching points at each of which a different drive signal of the plurality of drive signals is selectable and supplying the selected drive signal to the means for generating energy.

2. The ink-jet printer according to claim 1 wherein the means for selecting the drive signal switches the selection of the drive signal to another drive signal of the plurality of drive signals at a point between the cycle T in which the ink droplet is ejected and a next cycle T.

3. The ink-jet printer according to claim 1 wherein the means for selecting the drive signal switches the selection of the drive signal to another drive signal of the plurality of drive signals any point during the cycle T in which the ink droplet is ejected.

4. The ink-jet printer comprising:

a droplet outlet orifice through which an ink droplet is ejected, means for generating energy for ejecting the ink droplet through the outlet orifice;

means for generating a plurality of drive signals including a drive signal having a varying voltage waveform that disables ink droplet ejection in isolation from another waveform; and means for selecting a drive signal from the plurality of drive signals in a time-division manner where a waveform of a cycle T is divided into switching points at each of which a different drive signal of the plurality of drive signals is selectable and supplying the selected drive signal to the means for generating energy.

5. The ink-jet printer according to claim 4 wherein the means for selecting the drive signal switches the selection of the drive signal to another drive signal of the plurality of drive signals at any point between the cycle T in which the ink droplet is ejected and a next cycle T.

6. The ink-jet printer according to claim 4 wherein the means for selecting the drive signal switches the selection of the drive signal to another drive signal of the plurality of drive signals at any point including a point during the cycle T in which the ink droplet is ejected.

7. An apparatus for driving a recording head for an ink-jet printer including a droplet outlet orifice through which an ink droplet is ejected and a means for generating energy for having the ink droplet ejected through the outlet orifice, comprising:

means for generating a plurality of drive signals; and means for selecting any one drive signal of the plurality of drive signals in a time-division manner where a waveform of a cycle T is divided into switching points at each of which a different drive signal of the plurality of drive signals is selectable and supplying the selected drive signal to the means for generating energy.

8. The apparatus according to claim 7 wherein the means for selecting the drive signal switches the selection of the drive signal to another drive signal of the plurality of drive signals at a point between the cycle T in which the ink droplet is ejected and a next cycle T.

9. The apparatus according to claim 7 wherein the means for selecting the drive signal switches the selection of the drive signal to another drive signal of the plurality of drive signals at any point including a point during the cycle T in which the ink droplet is ejected.

10. An apparatus for driving a recording head for an ink-jet printer including a droplet outlet orifice through which an ink droplet is ejected and a means for generating energy for having the ink droplet ejected through the outlet orifice, comprising:

means for generating a plurality of drive signals including a drive signal having a varying voltage waveform that disables ink droplet ejection in isolation from another waveform; and means for selecting any one drive signal of the plurality of drive signals in a time-division manner where a waveform of a cycle T is divided into switching points at each of which a different drive signal of the plurality of drive signals is selectable and supplying the selected drive signal to the means for generating energy.

11. The apparatus according to claim 10 wherein the means for selecting the drive signal switches the selection of the drive signal to another drive signal of the plurality of drive signals at a point between the cycle T in which the ink droplet is ejected and a next cycle T.

12. The apparatus according to claim 10 wherein the means for selecting the drive signal switches the selection of the drive signal to another drive signal of the plurality of drive signals at any point including a point during the cycle T in which the ink droplet is ejected.

13. A method of driving a recording head for an ink-jet printer including a droplet outlet orifice through which an ink droplet is ejected and means for generating energy for ejecting the ink droplet through the outlet orifice, comprising the steps of:

generating a plurality of drive signals; and selecting any one drive signal of the plurality of drive signals in a time-division manner where a waveform of a cycle T is divided into switching points at each of which a different drive signal of the plurality of drive signals is selectable and supplying the selected drive signal to the means for generating energy.

14. The method according to claim 13 wherein the selection of the drive signal is switched to the selection of another drive signal of the plurality of drive signals at a point between the cycle T in which the ink droplet is ejected and a next cycle T.

15. The method according to claim 13 wherein the selection of the drive signal is switched to the selection of another drive signal of the plurality of drive signals at any point including a point during the cycle T in which the ink droplet is ejected.

16. A method of driving a recording head for an ink-jet printer including a droplet outlet orifice through which an ink droplet is ejected and means for generating energy for ejecting the ink droplet through the outlet orifice, comprising the steps of:

generating a plurality of drive signals including a drive signal having a varying voltage waveform that disables ink droplet ejection in isolation from another waveform; and selecting one drive signal of the plurality of drive signals in a time-division manner where a waveform of a cycle T is divided into switching points at each of which a different drive signal of the plurality of drive signals is selectable and supplying the selected drive signal to the means for generating energy.

17. The method according to claim 16 wherein the selection of the drive signal is switched to the selection of another drive signal of the plurality of drive signals at a point between the cycle T in which the ink droplet is ejected and a next cycle T.

18. The method according to claim 16 wherein the selection of the drive signal is switched to the selection of another drive signal of the plurality of drive signals at any point including a point during the cycle T in which the ink droplet is ejected.

* * * * *